US012228316B2

(12) United States Patent
Dong et al.

(10) Patent No.: US 12,228,316 B2
(45) Date of Patent: Feb. 18, 2025

(54) HEAT EXCHANGE APPARATUS

(71) Applicant: SANHUA (HANGZHOU) MICRO CHANNEL HEAT EXCHANGER CO., LTD., Zhejiang (CN)

(72) Inventors: Zhiming Dong, Zhejiang (CN); Peng Qin, Zhejiang (CN); Jianlong Jiang, Zhejiang (CN); Michael Shows, Zhejiang (CN); James Thomas, Zhejiang (CN)

(73) Assignee: SANHUA (HANGZHOU) MICRO CHANNEL HEAT EXCHANGER CO., LTD., Zhejiang (CN)

( * ) Notice: Subject to any disclaimer, the term of this patent is extended or adjusted under 35 U.S.C. 154(b) by 224 days.

(21) Appl. No.: 17/916,365

(22) PCT Filed: Apr. 1, 2021

(86) PCT No.: PCT/CN2021/084947
§ 371 (c)(1),
(2) Date: Sep. 30, 2022

(87) PCT Pub. No.: WO2021/197427
PCT Pub. Date: Oct. 7, 2021

(65) Prior Publication Data

US 2023/0152012 A1 May 18, 2023

(30) Foreign Application Priority Data

Apr. 2, 2020 (CN) ..... 202010256826.X
Apr. 2, 2020 (CN) ..... 202020472717.7

(51) Int. Cl.
*F25B 39/02* (2006.01)
*F24F 13/30* (2006.01)
(Continued)

(52) U.S. Cl.
CPC ..... *F25B 39/028* (2013.01); *F24F 13/30* (2013.01); *F28F 1/34* (2013.01); *F28F 9/26* (2013.01); *F25B 2500/09* (2013.01)

(58) Field of Classification Search
CPC ..... F25B 39/028; F25B 41/26; F25B 2339/0242; F25B 2500/09; F24F 13/30; F28F 1/34; F28F 9/26
See application file for complete search history.

(56) References Cited

U.S. PATENT DOCUMENTS 7,152,416 B2 * 12/2006 Lifson ..... F25B 41/26 62/196.3
2009/0277197 A1 * 11/2009 Gambiana ..... F25B 39/028 62/115
(Continued)

FOREIGN PATENT DOCUMENTS

CN 203286911 U 11/2013
CN 203810795 U 9/2014
(Continued)

*Primary Examiner* — Marc E Norman
(74) *Attorney, Agent, or Firm* — Bridgeway IP Law Group, PLLC; Jihun Kim

(57) ABSTRACT

A heat exchange apparatus includes a heat exchanger, a refrigerant adjustment component, and a first connecting member. The heat exchanger includes a first pipe, a second pipe, a plurality of heat exchange tubes connecting the first pipe and the second pipe, and an edge plate located on an outer side of the plurality of heat exchange tubes in a length direction of the first pipe. At least part of the refrigerant adjustment component is located on an outer side of the edge plate in the length direction of the first pipe. An included angle between an axis in a length direction of at least part of an outer wall of the refrigerant adjustment component and an axis in the length direction of the first pipe is greater than 0° and less than or equal to 90°.

17 Claims, 21 Drawing Sheets

(51) Int. Cl.
*F28F 1/34* (2006.01)
*F28F 9/26* (2006.01)

(56) References Cited

U.S. PATENT DOCUMENTS

| | | | | |
|---|---|---|---|---|
| 2016/0282025 | A1* | 9/2016 | Moreau | F28F 9/0253 |
| 2018/0058737 | A1 | 3/2018 | Nagafuji | |
| 2021/0310742 | A1* | 10/2021 | Zhao | F28F 1/08 |
| 2023/0400222 | A1* | 12/2023 | Aly | F24F 1/0067 |

FOREIGN PATENT DOCUMENTS

| | | | |
|---|---|---|---|
| CN | 209445536 | U | 9/2019 |
| CN | 212132956 | U | 12/2020 |

* cited by examiner

HEAT EXCHANGE APPARATUS

CROSS-REFERENCE TO RELATED APPLICATIONS

This application is a U.S. National Stage of International Application No. PCT/CN2021/084947, filed on Apr. 1, 2021, which claims priority and rights to Chinese Patent Applications No. 202010256826.X, and No. 202020472717.7 filed on Apr. 2, 2020, which are incorporated herein by reference in their entireties.

TECHNICAL FIELD

Embodiments of this application relate to the field of heat exchange technologies, and more particularly, to a heat exchange apparatus.

BACKGROUND

Household and commercial heat pump air-conditioning systems in related technologies can switch between a cooling mode and a heating mode. In the cooling mode, an indoor heat exchanger serves as an evaporator, and an outdoor heat exchanger serves as a condenser. In the heating mode, the indoor heat exchanger serves as a condenser, and the outdoor heat exchanger serves as an evaporator.

Due to different sizes and internal volumes of the indoor heat exchanger and the outdoor heat exchanger, the system requires different amounts of refrigerant, and an energy efficiency ratio on the indoor side varies in the two modes of cooling and heating, which reduces efficiency of the heat pump system.

SUMMARY

A heat exchange apparatus in embodiments of a first aspect of this application includes: a heat exchanger, where the heat exchanger includes a first pipe, a second pipe, and a plurality of heat exchange tubes, the first pipe and the second pipe are arranged spaced apart, the plurality of heat exchange tubes are arranged spaced apart along a length direction of the first pipe, one end of the heat exchange tube is inserted into the first pipe to be communicated with the first pipe, the other end of the heat exchange tube is inserted into the second pipe to be communicated with the second pipe, the heat exchange tube includes a channel, the channel communicates the first pipe and the second pipe, the heat exchanger further includes an edge plate, and the edge plate is located on an outer side of the plurality of heat exchange tubes in the length direction of the first pipe; a refrigerant adjustment component, where at least part of the refrigerant adjustment component is located on an outer side of the edge plate in the length direction of the first pipe, the refrigerant adjustment component includes a cavity for accommodating refrigerant and an outer wall enclosing the cavity, the outer wall of the refrigerant adjustment component has an opening for refrigerant flow, and an included angle between an axis in a length direction of at least part of the outer wall of the refrigerant adjustment component and an axis in the length direction of the first pipe is greater than 0° and less than or equal to 90°; and a first connecting member, where the first connecting member communicates the opening of the refrigerant adjustment component and the first pipe, and in a direction of gravity, the opening of the refrigerant adjustment component is higher than a communication position between the first connecting member and the first pipe.

A heat pump system in embodiments of a second aspect of this application includes a compressor, a flow direction switching member, a throttle member, a first heat exchanger, and a second heat exchanger. The compressor, the throttle member, the first heat exchanger, and the second heat exchanger each include a first opening and a second opening, the first opening of the first heat exchanger is communicated with the first opening of the compressor through the flow direction switching member, the second opening of the first heat exchanger is communicated with the first opening of the throttle member, the first opening of the second heat exchanger is communicated with the second opening of the throttle member, and the second opening of the second heat exchanger is communicated with the second opening of the compressor through the flow direction switching member. At least one of the first heat exchanger and the second heat exchanger includes: a first pipe, a second pipe, and a plurality of heat exchange tubes, where the first pipe and the second pipe are arranged spaced apart, the plurality of heat exchange tubes are arranged spaced apart along a length direction of the first pipe, one end of the heat exchange tube is inserted into the first pipe to be communicated with the first pipe, the other end of the heat exchange tube is inserted into the second pipe to be communicated with the second pipe, the heat exchange tube includes a channel, the channel communicates the first pipe and the second pipe, the heat exchanger further includes an edge plate, and the edge plate is located on an outer side of the plurality of heat exchange tubes in the length direction of the first pipe; a refrigerant adjustment component, where at least part of the refrigerant adjustment component is located on an outer side of the edge plate in the length direction of the first pipe, the refrigerant adjustment component includes a cavity for accommodating refrigerant and an outer wall enclosing the cavity, the outer wall of the refrigerant adjustment component has an opening for refrigerant flow, and an included angle between an axis in a length direction of at least part of the outer wall of the refrigerant adjustment component and an axis in the length direction of the first pipe is greater than 0° and less than or equal to 90°; and a first connecting member, where the first connecting member communicates the opening of the refrigerant adjustment component and the first pipe, and in a direction of gravity, the opening of the refrigerant adjustment component is higher than a communication position between the first connecting member and the first pipe.

DESCRIPTION OF EMBODIMENTS

Embodiments of this application are described in detail below, and examples of the embodiments are shown in the accompanying drawings. The embodiments described below with reference to the accompanying drawings are examples, and are intended to explain this application, but shall not be understood as a limitation on this application. In the description of this application, it should be understood that an orientation or positional relationship indicated by the term "center", "longitudinal", "transverse", "length", "width", "thickness", "upper", "lower", "front", "back", "left", "right", "vertical", "horizontal", "top", "bottom", "internal", "external", "clockwise", "counterclockwise", "axial direction", "radial direction", "circumferential direction", or the like is based on an orientation or positional relationship shown in the accompanying drawings, and is merely for ease of describing this application and simplifying the description, but does not indicate or imply that an apparatus or an element fixture referred to must have a specific orientation or be constructed and operated in a specific orientation, and therefore cannot be understood as a limitation on this application.

As shown in FIG. 1 to FIG. 24, a heat exchange apparatus according to embodiments of this application includes a heat exchanger 10, a refrigerant adjustment component 20, and a first connecting member 30.

Figure 1:
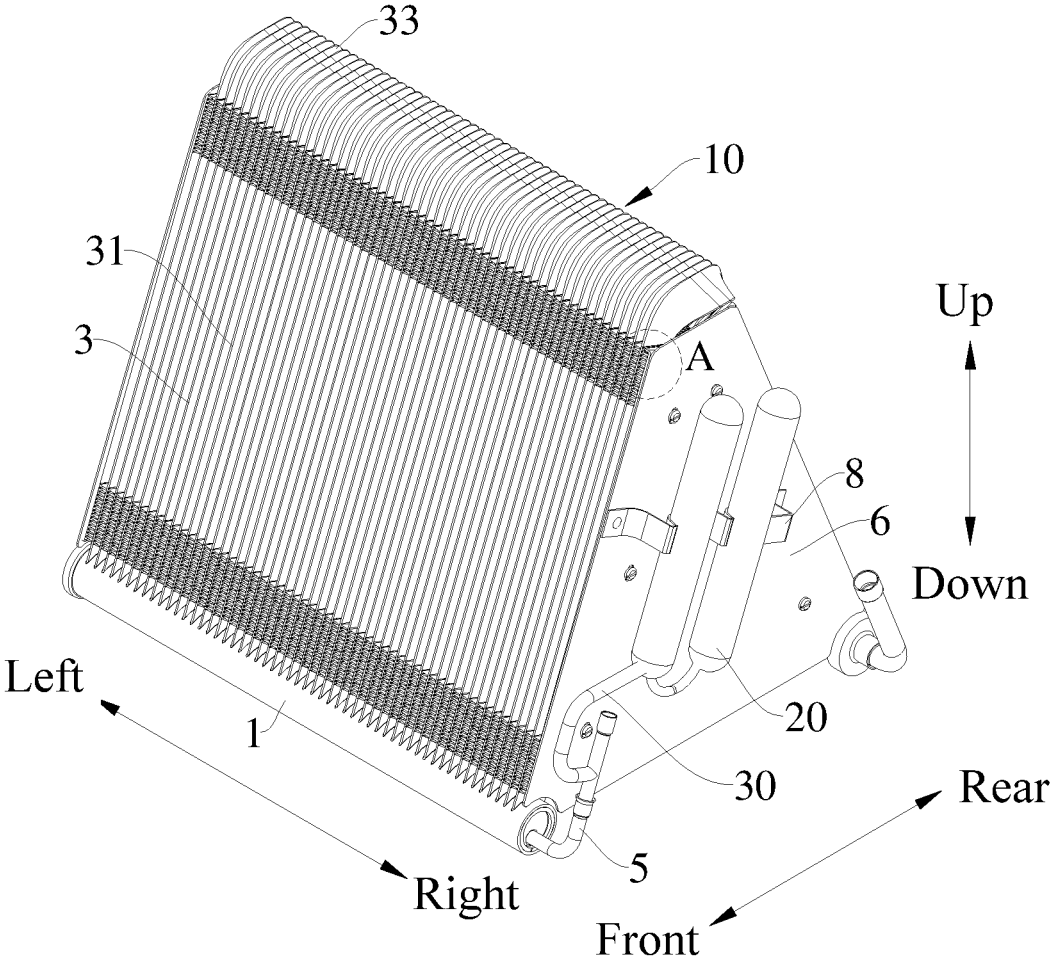
FIG. 1 is a schematic diagram of a structure of a heat exchanger according to an embodiment of this application.
Figure 2:
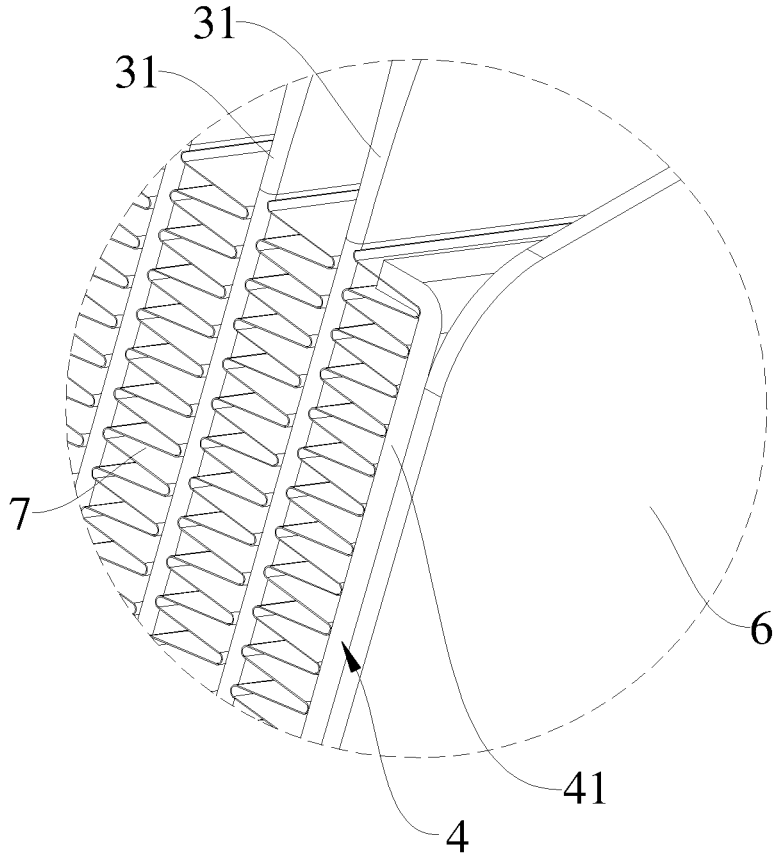
FIG. 2 is a partially enlarged view of A in FIG. 1.
Figure 3:
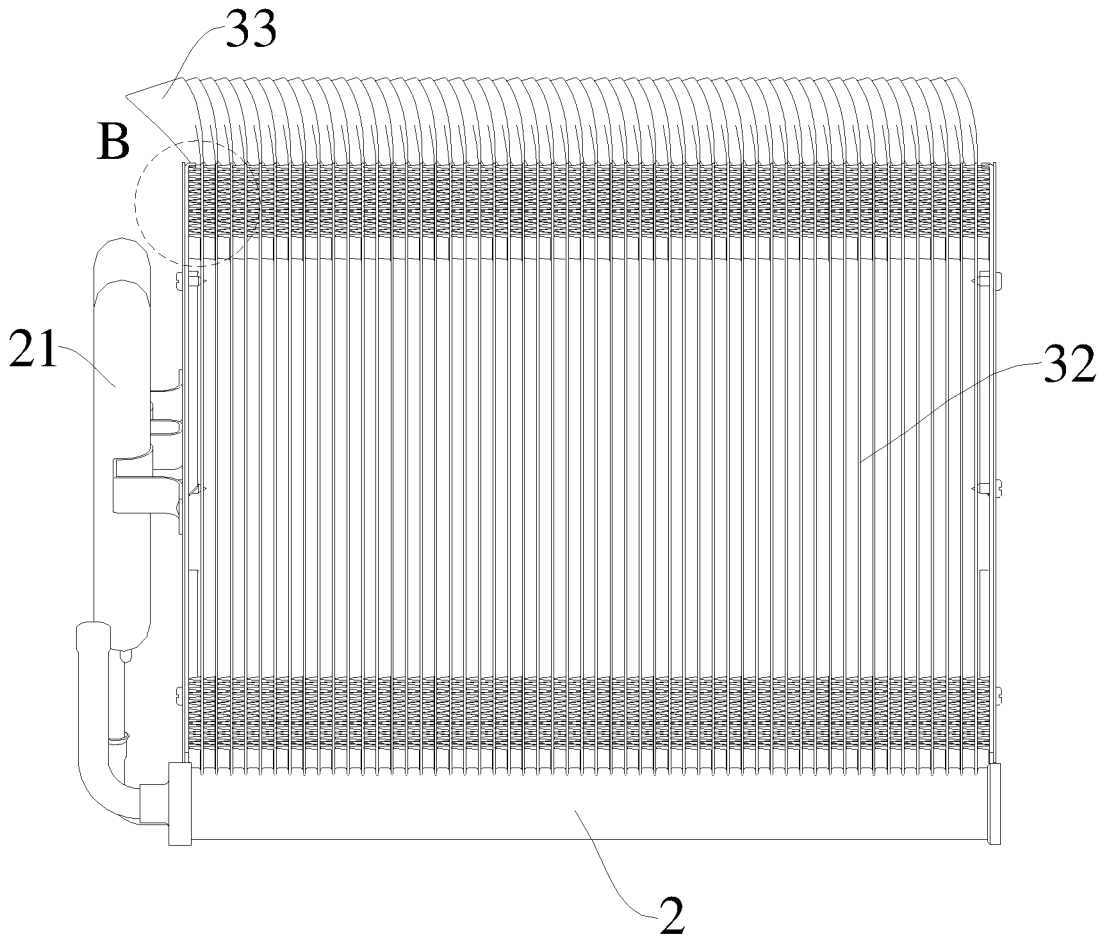
FIG. 3 is a main view of the heat exchanger in FIG. 1.
Figure 4:
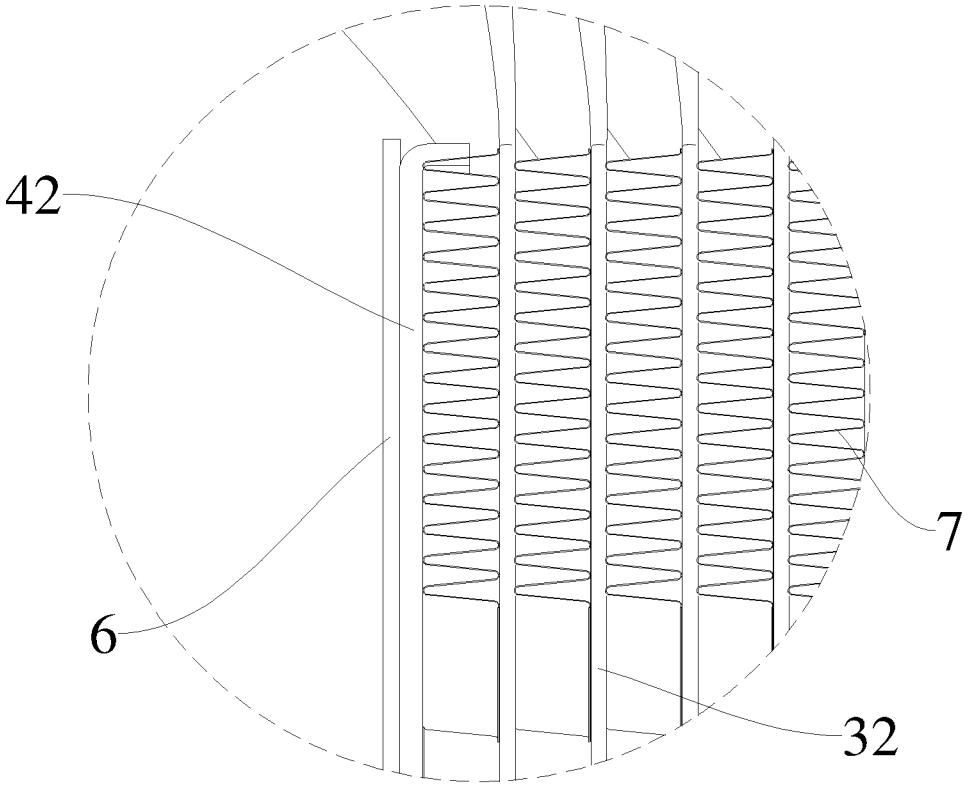
FIG. 4 is a partially enlarged view of B in FIG. 3.
Figure 5:
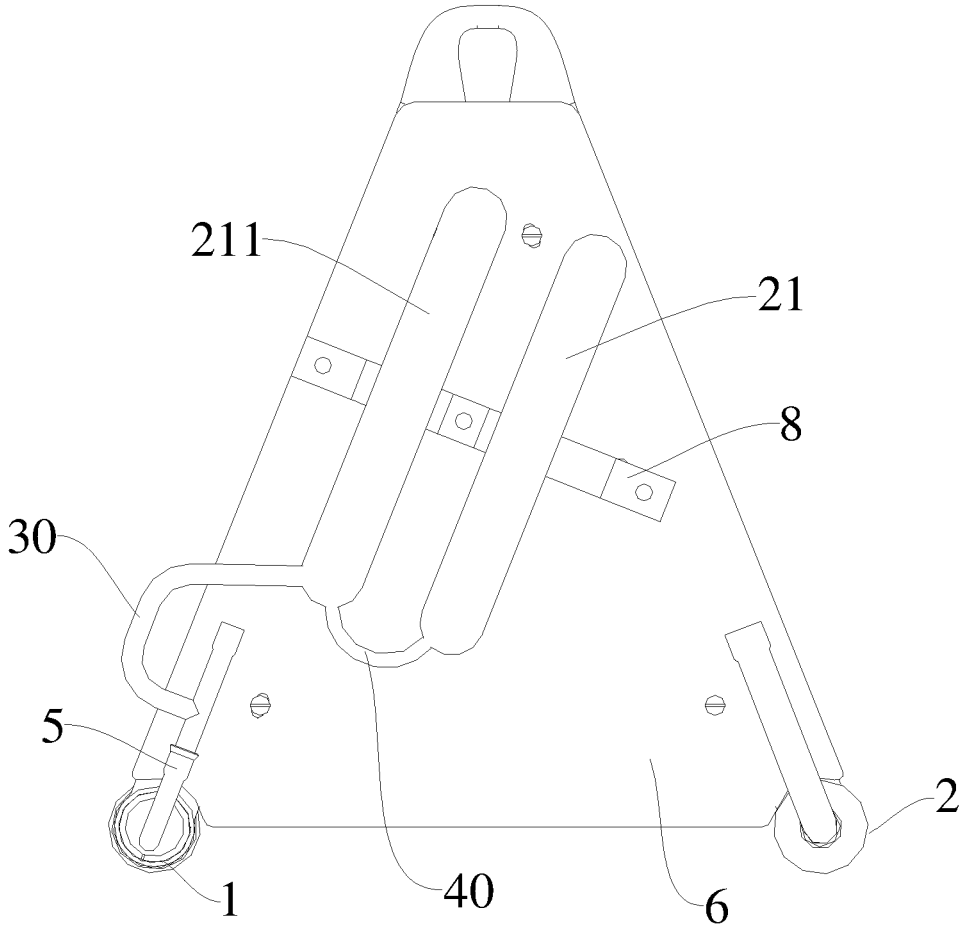
FIG. 5 is a side view of the heat exchanger in FIG. 1.
Figure 14:
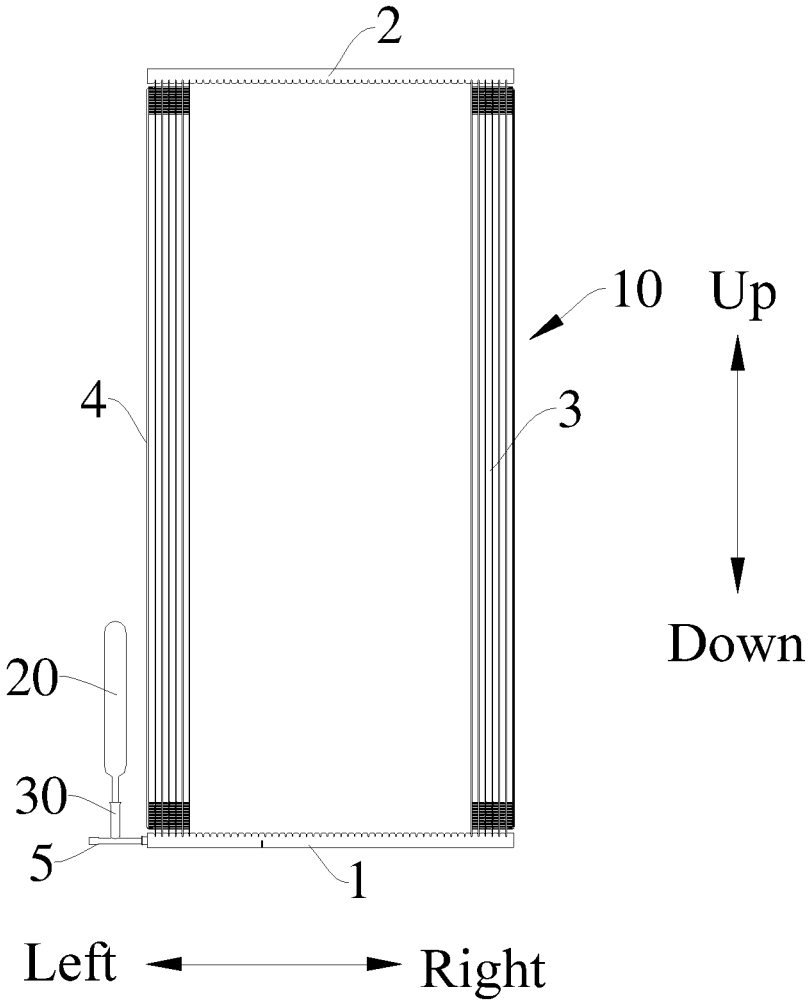
FIG. 14 is a schematic diagram of a structure of a heat exchanger according to a still further embodiment of this application.

The heat exchanger 10 includes a first pipe 1, a second pipe 2, and a plurality of heat exchange tubes 3. The first pipe 1 and the second pipe 2 are arranged spaced apart. As shown in FIG. 1, the first pipe 1 and the second pipe 2 are spaced apart in a front-rear direction. Specifically, the first pipe 1 and the second pipe 2 are arranged roughly in parallel. As shown in FIG. 1 and FIG. 14, both the first pipe 1 and the second pipe 2 roughly extend in a left-right direction. In other words, both a length direction of the first pipe 1 and a length direction of the second pipe 2 are the left-right direction.

The plurality of heat exchange tubes 3 are arranged spaced apart in the length direction of the first pipe 1. As shown in FIG. 1 and FIG. 14, the plurality of heat exchange tubes 3 are arranged spaced apart in the left-right direction.

The heat exchanger 10 further includes an edge plate 4, and the edge plate 4 is located on an outer side of the plurality of heat exchange tubes 3 in the length direction of the first pipe 1. It should be noted herein that a direction toward a center position in the length direction of the first pipe 1 is inward, and a direction away from the center position in the length direction of the first pipe 1 is outward. Specifically, there are at least two edge plates 4, one of the edge plates 4 is located on a rightmost side of the plurality of heat exchange tubes 3, and another edge plate 4 is located on a leftmost side of the plurality of heat exchange tubes 3.

At least part of the refrigerant adjustment component 20 is located on an outer side of the edge plate 4 in the length direction of the first pipe 1. In other words, the refrigerant adjustment component 20 is arranged on a side, away from the plurality of heat exchange tubes 3, of the edge plate 4. Specifically, the refrigerant adjustment component 20 may be located on a left side of a left edge plate, and/or on a right side of a right edge plate 4.

The refrigerant adjustment component 20 includes a cavity for accommodating refrigerant and an outer wall enclosing the cavity. The outer wall of the refrigerant adjustment component 20 has an opening for refrigerant flow. An included angle between an axis in a length direction of at least part of the outer wall of the refrigerant adjustment component 20 and an axis in the length direction of the first pipe 1 is greater than 0° and less than or equal to 90°.

The first connecting member 30 communicates the opening of the refrigerant adjustment component 20 and the first pipe 1, and in a direction of gravity, the opening of the refrigerant adjustment component 20 is higher than a communication position between the first connecting member 30 and the first pipe 1. Specifically, one end of the first connecting member 30 is connected to the opening of the refrigeration adjustment component 20, and the other end of the first connecting member 30 is communicated with the first pipe 1. The other end of the first connecting member 30 may be directly communicated with the first pipe 1, and in this case, the opening of the refrigerant adjustment component 20 is higher than the communication position between the other end of the first connecting member 30 and the first pipe 1. Alternatively, an end of the first pipe 1 in the length direction is connected to an inlet/outlet pipe 5, and the inlet/outlet pipe 5 is communicated with the other end of the first connecting member 30. In this case, the opening of the refrigerant adjustment component 20 is higher than a communication position between the other end of the first connecting member 30 and the inlet/outlet pipe 5.

In a heat pump system, that a volume of an outdoor heat exchanger is greater than that of an indoor heat exchanger is used as an example. When the heat pump system switches from a cooling mode to a heating mode, the indoor heat exchanger serves as a condenser. Injection space of the indoor heat exchanger is limited. Therefore, according to the heat exchange apparatus in this application, the refrigerant adjustment component 20 communicated with the first pipe 1 through the first connecting member 30 is disposed on the outer side of the edge plate 4 in the length direction of the first pipe 1. The included angle between the axis in the length direction of the at least part of the outer wall of the refrigerant adjustment component 20 and the axis in the length direction of the first pipe 1 is greater than 0° and less than or equal to 90°. Excess refrigerant enters the refrigerant adjustment component 20 communicated with the heat exchanger 10, and excess liquid refrigerant is stored by using the refrigerant adjustment component 20, to improve an operating capability of the heat pump system. When the heat pump system switches from the heating mode to the cooling mode, the indoor heat exchanger serves as an evaporator, and the heat pump system needs more refrigerant to improve heat exchange efficiency. In this case, in the direction of gravity, the opening of the refrigerant adjustment component 20 is higher than the communication position between the first connecting member 30 and the first pipe 1, and liquid refrigerant in the refrigerant adjustment component 20 flows into the heat exchanger 10 because of gravity of the liquid refrigerant to participate in heat exchange of the heat pump system, so as to improve heat exchange performance. In this way, the heat exchange apparatus according to the embodiments of this application is used as a smaller-volume heat exchanger, so that when the heat pump system switches between the cooling mode and the heating mode, refrigerant in the heat pump system can be compensated and adjusted. Therefore, an amount of exchanged heat and an energy efficiency ratio on the indoor side are stabilized in both the cooling mode and the heating mode, thereby improving efficiency of the heat pump system.

In some specific embodiments, as shown in FIG. 15 to FIG. 24, the plurality of heat exchange tubes 3 are arranged in parallel, and each heat exchange tube 3 extends in an up-down direction, so that the heat exchanger 10 is a parallel flow heat exchanger.

It can be understood that this application is not limited thereto. In some other embodiments, as shown in FIG. 1 to FIG. 13, the heat exchange tube 3 includes a first straight section 31, a second straight section 32, and a connecting section 33. One end of the first straight section 31 in a length direction of the first straight section 31 is inserted into the first pipe 1 to be communicated with the first pipe 1, and the other end of the first straight section 31 in the length direction of the first straight section 31 is communicated with one end of the connecting section 33. One end of the second straight section 32 in a length direction of the second straight section 32 is inserted into the second pipe 2 to be communicated with the second pipe 2, and the other end of the second straight section 32 in the length direction of the second straight section 32 is communicated with the other end of the connecting section 33. The connecting section 33 is bent with respect to the first straight section 31 and the second straight section 32. The first straight section 31, the connecting section 33, and the second straight section 32 include a channel, and the channel communicates the first pipe 1 and the second pipe 2. An included angle between the length direction of the first straight section 31 and the length direction of the second straight section 32 is greater than or equal to 0° and less than 180°. Therefore, the heat exchanger 10 is a bent heat exchanger.

Figure 6:
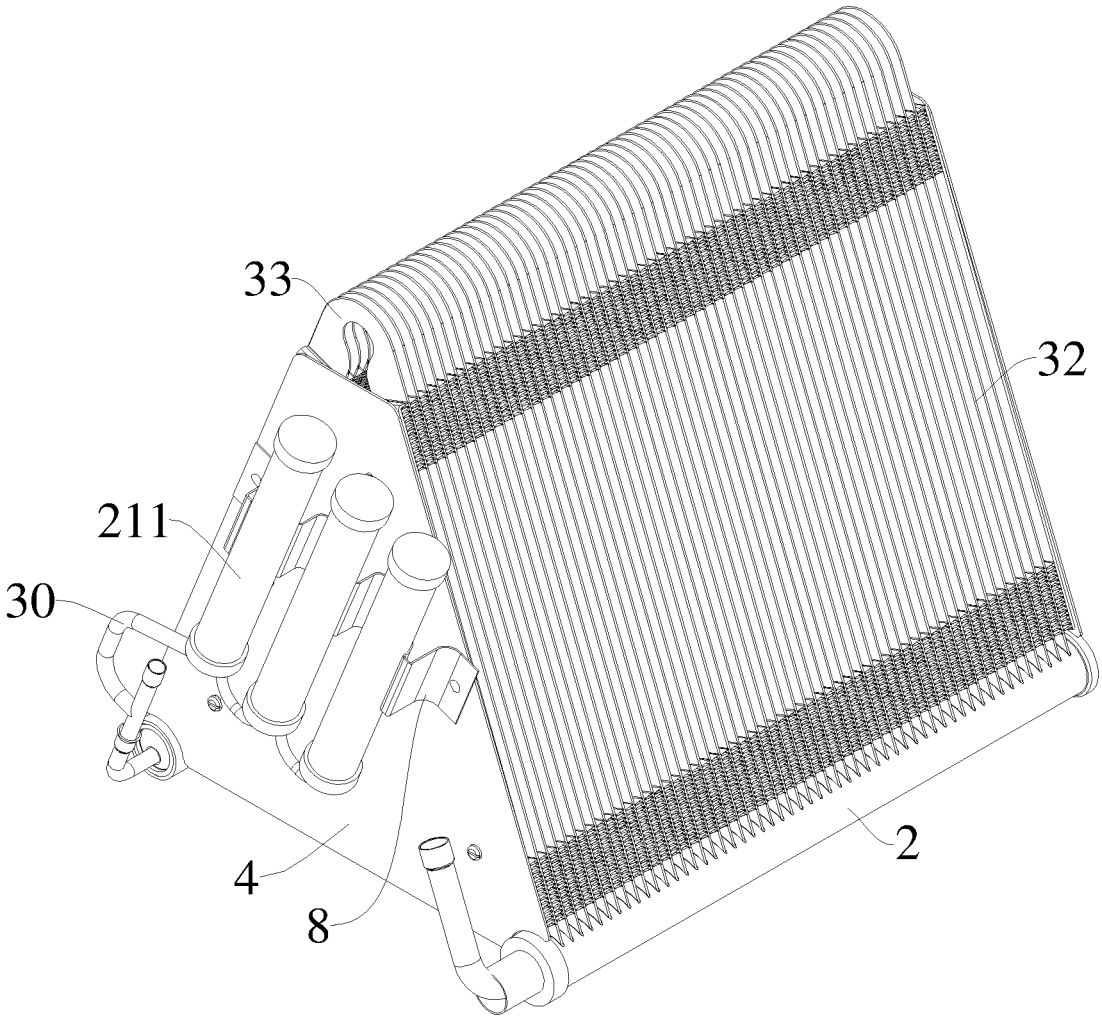
FIG. 6 is a schematic diagram of a structure of a heat exchanger according to another embodiment of this application.
Figure 7:
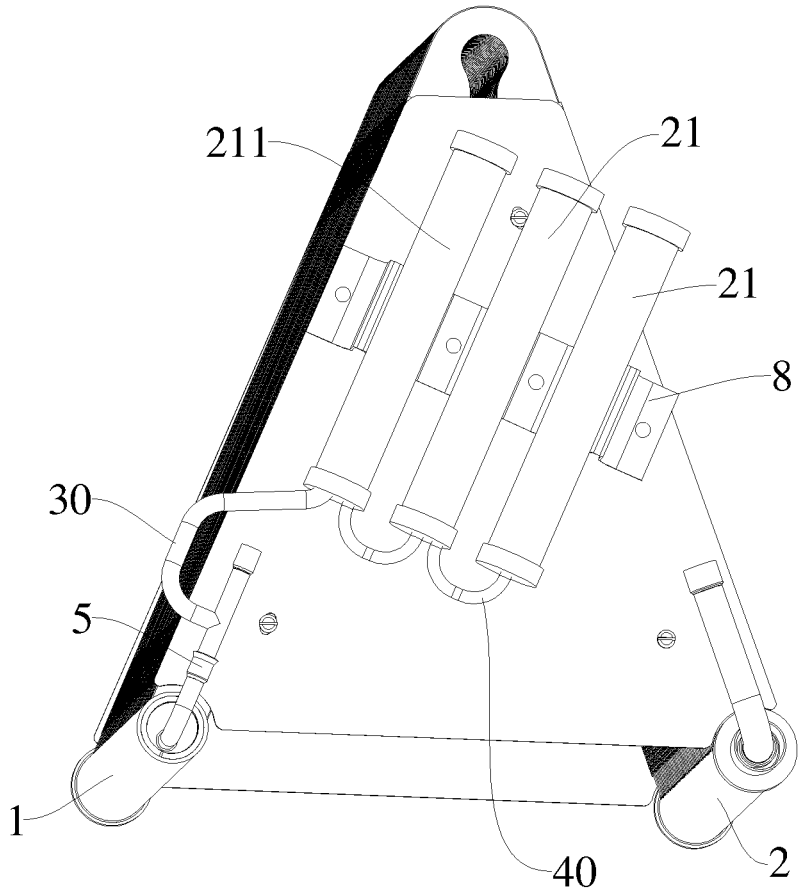
FIG. 7 is a view of the heat exchanger in FIG. 6 from another angle.
Figure 8:
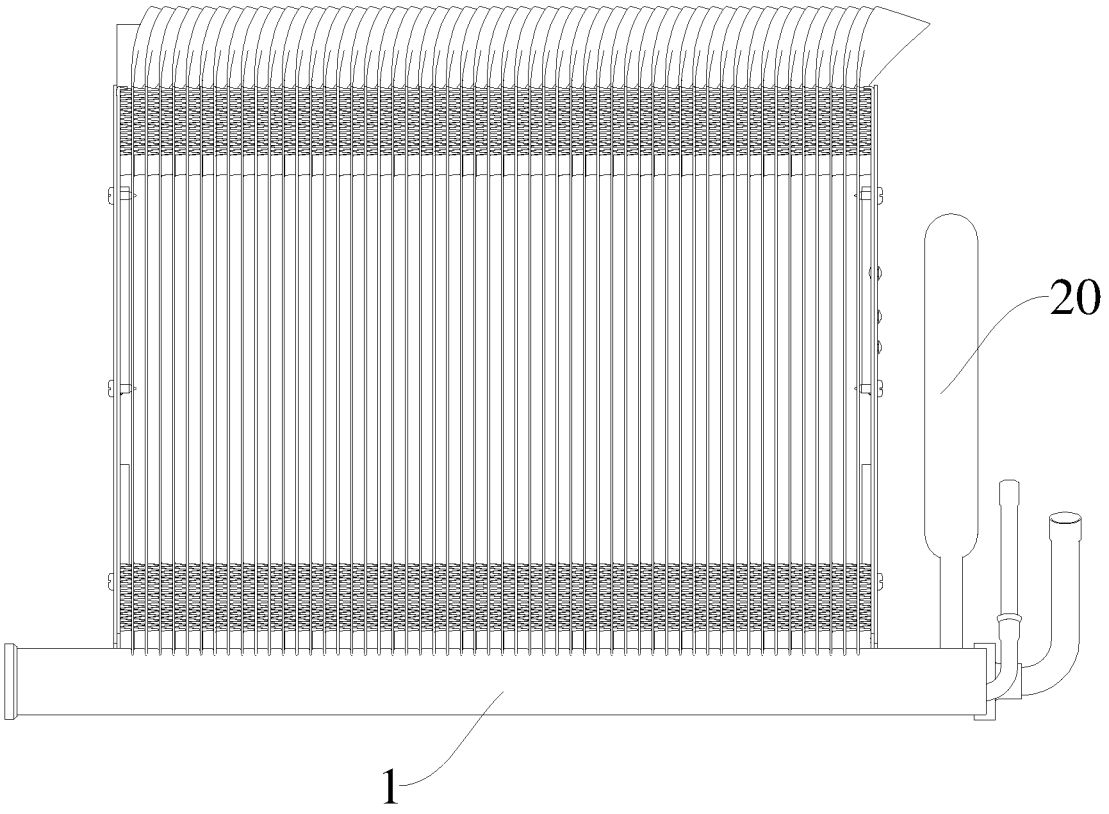
FIG. 8 is a main view of a heat exchanger according to still another embodiment of this application.
Figure 9:
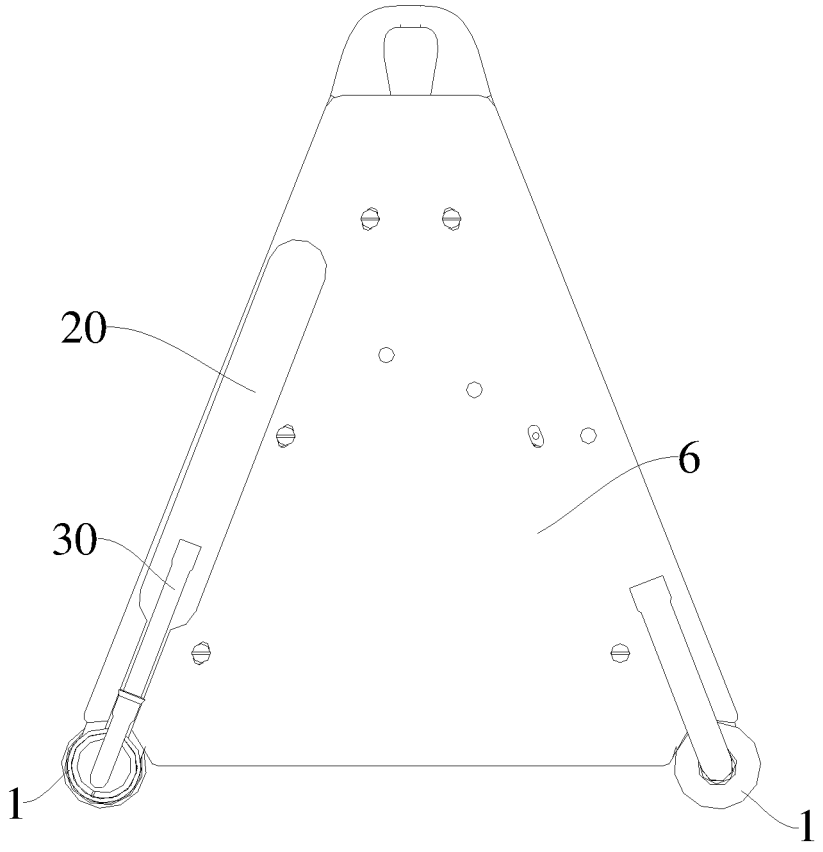
FIG. 9 is a side view of the heat exchanger in FIG. 8.

Specifically, a lower end of the first straight section 31 is inserted into the first pipe 1 to be communicated with the first pipe 1, and a lower end of the second straight section 32 is inserted into the second pipe 2 to be communicated with the second pipe 2. The connecting section 33 connects an upper end of the first straight section 31 and an upper end of the second straight section 32, and is bent with respect to the first straight section 31 and the second straight section 32. It should be noted herein that the connecting section 33 may be shown in FIG. 12 and FIG. 13, the connecting section 33 extends in the left-right direction, and the connecting section 33 is communicated with a plurality of first straight sections 31 and communicated with a plurality of second straight sections 32. It can be understood that this application is not limited thereto. For example, the connecting section 33 may alternatively be a curved section. The curved section may be bent only with respect to the first straight section 31 and the second straight section 32, as shown in FIG. 6. The curved section may alternatively be twisted and bent with respect to the first straight section 31 and the second straight section 32, as shown in FIG. 1.

The heat exchange tube 3 includes at least one channel, and the channel extends from the first straight section 31 to the second straight section 32 through the connecting section 33, so as to communicate the first pipe 1 and the second pipe 2. The first straight section 31 and the second straight section 32 may be arranged roughly in parallel, for example, both the first straight section 31 and the second straight section 32 extend in the up-down direction. In addition, the length direction of the first straight section 31 and the length direction of the second straight section 32 may have an included angle, and the included angle is greater than 0° and less than 180°.

The edge plate 4 includes a first edge plate 41 located on an outer side of first straight sections 31 of the plurality of heat exchange tubes 3 in the length direction of the first pipe 1, and a second edge plate 42 located on an outer side of second straight sections 32 of the plurality of heat exchange tubes 3 in the length direction of the first pipe 1. In other words, the outer side of the plurality of first straight sections 31 in the length direction of the first pipe 1 and the outer side of the plurality of second straight sections 32 in the length direction of the first pipe 1 each are provided with the edge plates 4. It should be noted herein that a direction toward a center position in the length direction of the first pipe 1 is inward, and a direction away from the center position in the length direction of the first pipe 1 is outward. Specifically, there are at least two first edge plates 41, one of the first edge plates 41 is located on a rightmost side of the plurality of first straight sections 31, and another first edge plate 41 is located on a leftmost side of the plurality of first straight sections 31; there are at least two second edge plates 42, one of the second edge plates 42 is located on a rightmost side of the plurality of second straight sections 32, and another second edge plate 42 is located on a leftmost side of the plurality of second straight sections 32.

At least part of the refrigerant adjustment component 20 is located on an outer side of the first edge plate 41 and the second edge plate 42 in the length direction of the first pipe 1. In other words, the refrigerant adjustment component 20 is arranged on a side, away from the plurality of heat exchange tubes 3, of the edge plate 4. Specifically, the refrigerant adjustment component 20 may be located on a left side of a left first edge plate 41 and a left second edge plate 42, and/or on a right side of a right first edge plate 41 and a right second edge plate 42.

In some embodiments, the edge plate 4 includes a first side surface and a second side surface in the length direction of the first pipe 1, and the refrigerant adjustment component 20 is connected to at least one of the first side surface and the second side surface of the edge plate 4. In other words, in this embodiment, the refrigerant adjustment component 20 is mounted on the edge plate 4.

Specifically, in the embodiment shown in FIG. 14, the refrigerant adjustment component 20 is mounted on the left edge plate 4, and may be connected to a left side surface of the left edge plate 4. It can be understood that this application is not limited thereto. The refrigerant adjustment component 20 may alternatively be connected to a right side surface of the left edge plate 4. In this case, a dimension of the left edge plate 4 in the front-rear direction perpendicular to the up-down direction and the left-right direction (for example, a width of the left edge plate 4) is greater than a dimension of the heat exchange tube 3 in the front-rear direction (which is, for example, when the heat exchange tube 3 is a flat tube, a width of the flat tube), so as to exceed the heat exchange tube 3 in the front-rear direction. The refrigerant adjustment component 20 is connected to a right side surface of a part, exceeding the heat exchange tube 3, of the left edge plate 4.

When the heat exchanger 10 is a bent heat exchanger, as shown in FIG. 1 to FIG. 13, the length direction of the first straight section 31 is parallel to the length direction of the second straight section 32. The first edge plate 41 and the second edge plate 42 each include a first side surface and a second side surface in the length direction of the first pipe 1. The refrigerant adjustment component 20 is connected to at least one of the first side surface and the second side surface of the first edge plate 41, and/or at least one of the first side surface and the second side surface of the second edge plate 42. For example, the first straight section 31 and the second straight section 32 are spaced apart in the front-rear direction and are arranged roughly in parallel, the first pipe 1 extends in the left-right direction, and the first edge plate 41 and the second edge plate 42 each include an inner side surface and an outer side surface that are arranged opposite to each other. An inner side surface of the left first edge plate 41/second edge plate 42 is a right side surface of this first edge plate 41/second edge plate 42, and an outer side surface of the left first edge plate 41/second edge plate 42 is a left side surface of this first edge plate 41/second edge plate 42. An inner side surface of the right first edge plate 41/second edge plate 42 is a left side surface of this first edge plate 41/second edge plate 42, and an outer side surface of the right first edge plate 41/second edge plate 42 is a right side surface of this first edge plate 41/second edge plate 42. The refrigerant adjustment component 20 is connected to at least one of the left side surface and the right side surface of the first edge plate 41 and/or at least one of the left side surface and the right side surface of the second edge plate 42.

In some specific embodiments, the refrigerant adjustment component 20 may be connected to the first edge plate 41/second edge plate 42 on either side of the left side and the right side. Specifically, the refrigerant adjustment component 20 may be all located on the outer side of this first edge plate 41/second edge plate 42, and may be connected to the outer side surface of the first edge plate 41 and the outer side surface of the second edge plate 42; or may be connected only to the outer side surface of the first edge plate 41, or only to the outer side surface of the second edge plate 42. Alternatively, the refrigerant adjustment component 20 may be all located on the inner side of this first edge plate 41 and/or second edge plate 42, and may be connected to the inner side surface of the first edge plate 41 and the inner side surface of the second edge plate 42; or may be connected only to the inner side surface of the first edge plate 41, or only to the inner side surface of the second edge plate 42. Alternatively, a part of the refrigerant adjustment component 20 may be located on the outer side of the first edge plate 41 and/or the second edge plate 42, and the other part is located on the inner side of the first edge plate 41 and/or the second edge plate 42.

In some other specific embodiments, a part of the refrigerant adjustment component 20 may be connected to the first edge plate 41 and/or the second edge plate 42 on the left side, and the other part may be connected to the first edge plate 41 and/or the second edge plate 42 on the right side.

It can be understood that this application is not limited to a form in which the refrigerant adjustment component 20 is mounted on the edge plate 4. For example, in some other embodiments, the heat exchange apparatus further includes a mounting member 6, the mounting member 6 is disposed on an outer side of the edge plate 4 in the length direction of the first pipe 1, and the refrigerant adjustment component 20 is fixedly connected to the mounting member 6.

Specifically, in the embodiment shown in FIG. 14, the mounting member 6 is connected to the left side surface of the left edge plate 4, and the refrigerant adjustment component 20 is mounted on the mounting member 6.

When the heat exchanger 10 is a bent heat exchanger, as shown in FIG. 1 to FIG. 13, the included angle between the length direction of the first straight section 31 and the length direction of the second straight section 32 is greater than 0° and less than 180°. The mounting member 6 is disposed on the outer side of the first edge plate 41 and the second edge plate 42 in the length direction of the first pipe 1, and the refrigerant adjustment component 20 is fixedly connected to the mounting member 6. In other words, when the first straight section 31 and the second straight section 32 have an included angle, the mounting member 6 is connected to the outer side surface of the first edge plate 41 and the outer side surface of the second edge plate 42, and the refrigerant adjustment component 20 is mounted on the mounting member 6. Specifically, as shown in FIG. 1, FIG. 5, FIG. 6, and FIG. 7, the refrigerant adjustment component 20 is fastened on the mounting member 6 by a fastener 8.

Specifically, the mounting member 6 may be disposed only on an outer side of the first edge plate 41 and the second edge plate 42 on either side of the left side and the right side of the heat exchanger 10. In this case, the refrigerant adjustment component 20 is disposed only on this side of the heat exchanger 10, and as shown in FIG. 1 to FIG. 5, the refrigerant adjustment component 20 is disposed only on the right side of the right first edge plate 41 and second edge plate 42. Alternatively, the mounting member 6 may be disposed on an outer side of the first edge plate 41 and the second edge plate 42 on each side of the left side and the right side of the heat exchanger 10. In this case, refrigerant adjustment components 20 may be disposed on both the left and right sides of the heat exchanger 10, as shown in FIG. 10.

In some specific embodiments, the mounting member 6 includes a first side surface and a second side surface arranged spaced apart in the length direction of the first pipe 1, and the refrigerant adjustment component 20 is connected to at least one of the first side surface and the second side surface of the mounting member 6. For example, the first pipe 1 extends in the left-right direction, and the mounting member 6 includes an inner side surface and an outer side surface that are opposite to each other in the left-right direction. The refrigerant adjustment component 20 may be connected to the inner side surface of the mounting member 6, or may be connected only to the outer side surface of the mounting member 6. Alternatively, a part of the refrigerant adjustment component may be connected to the inner side surface of the mounting member 6, and the other part may be connected to the outer side surface of the mounting member 6. A left side surface of the mounting member 6 located on the left side of the heat exchanger 10 is the outer side surface, and a right side surface thereof is the inner side surface. A right side surface of the mounting member 6 located on the right side of the heat exchanger 10 is the outer side surface, and a left side surface thereof is the inner side surface.

In the specific embodiments shown in FIG. 1 to FIG. 5 and FIG. 8, the mounting member 6 is disposed on the right side of the right first edge plate 41 and second edge plate 42, and the refrigerant adjustment component 20 is disposed on the right side of the mounting member 6 and is connected to the right side surface of the mounting member 6.

Figure 10:
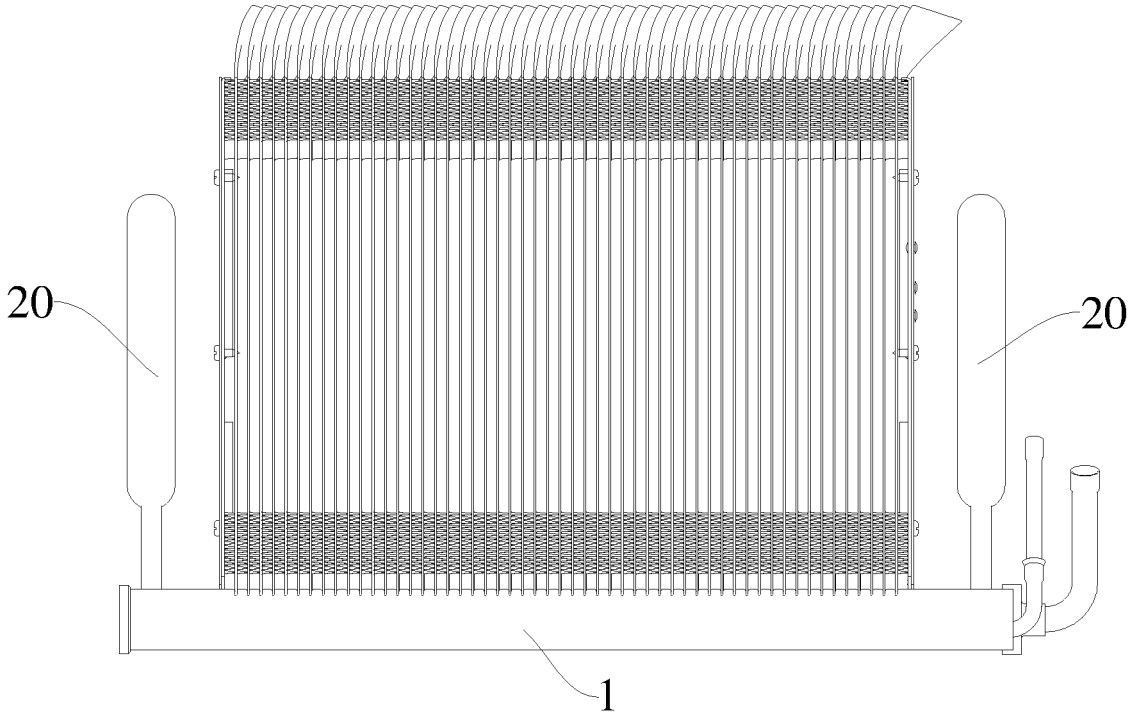
FIG. 10 is a main view of a heat exchanger according to yet another embodiment of this application.

In the specific embodiment shown in FIG. 10, one mounting member 6 is disposed on the right side of the right first edge plate 41 and second edge plate 42, and a part of the refrigerant adjustment component 20 is disposed on the right side of the mounting member 6 and is connected to the right side surface of the mounting member 6. Another mounting member 6 is disposed on the left side of the left first edge plate 41 and second edge plate 42, and the other part of the refrigerant adjustment component 20 is disposed on left side of the mounting member 6 and is connected to the left side surface of the mounting member 6.

Figure 11:
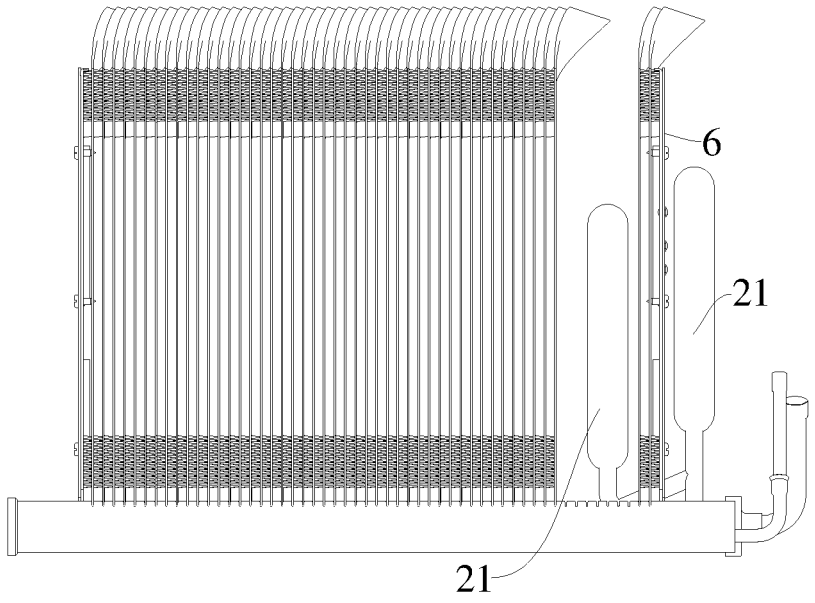
FIG. 11 is a main view of a heat exchanger according to still yet another embodiment of this application.
Figure 12:
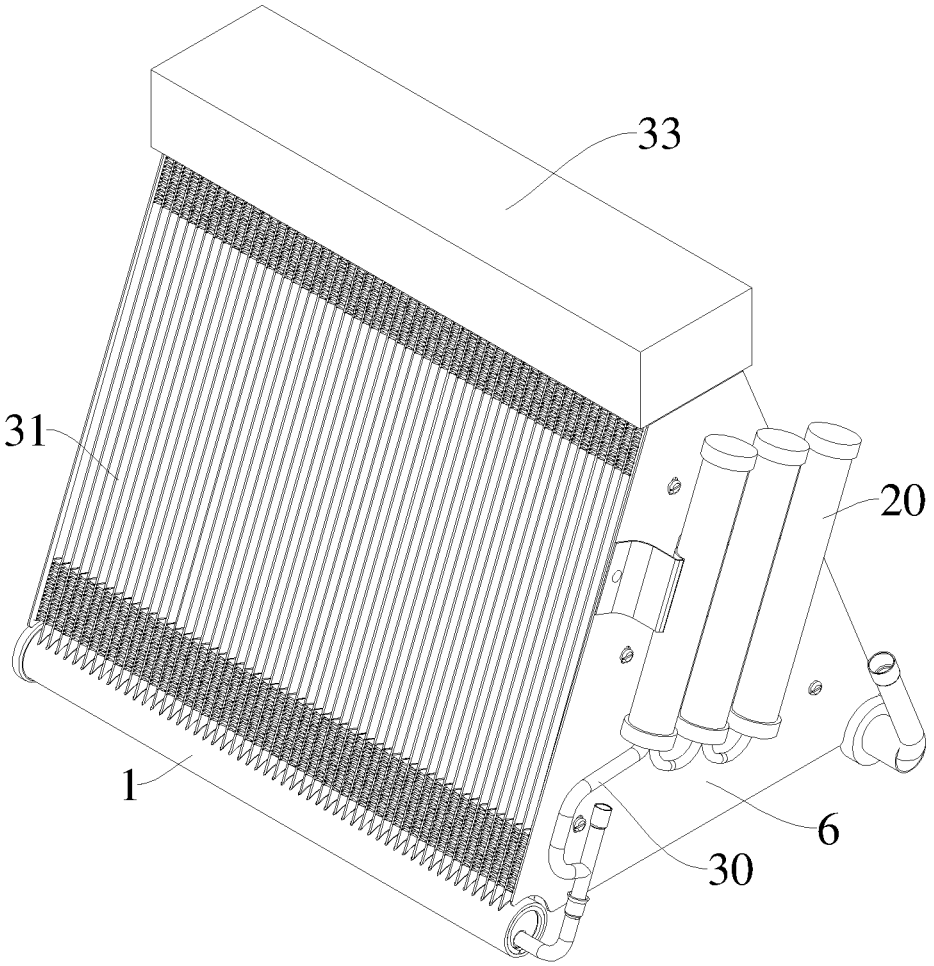
FIG. 12 is a schematic diagram of a structure of a heat exchanger according to a further embodiment of this application.
Figure 13:
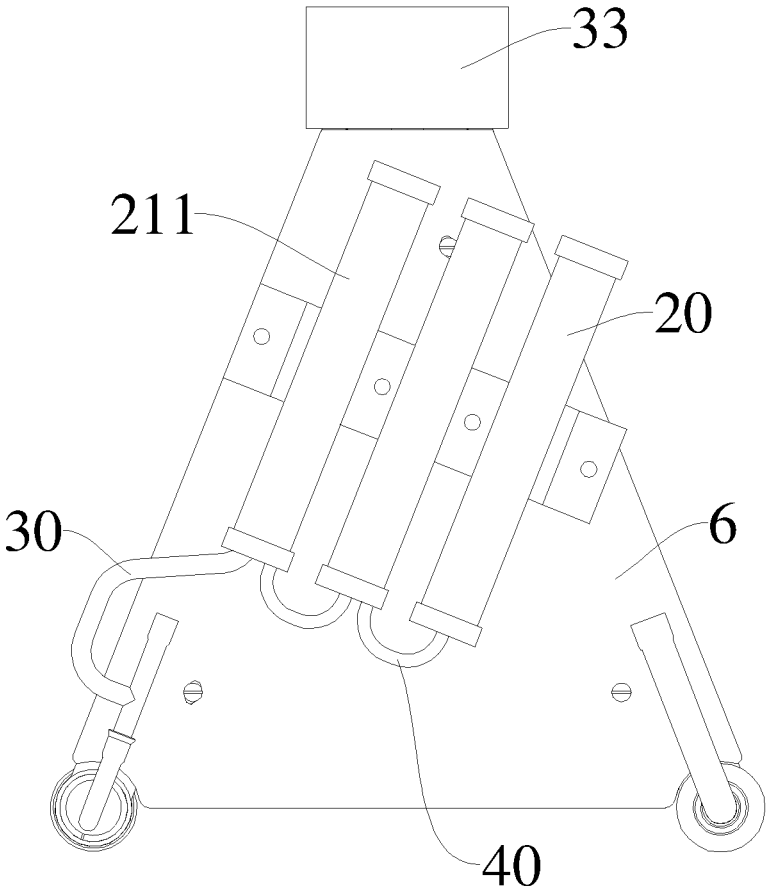
FIG. 13 is a side view of the heat exchanger in FIG. 12.

The arrangement position of the refrigerant adjustment component 20 in this application is not limited to those shown in FIG. 1 to FIG. 5, FIG. 8, and FIG. 10. For example, in some other specific embodiments, the refrigerant adjustment component 20 includes a plurality of adjustment members 21, at least one adjustment member 21 is connected to the first side surface of the mounting member 6, and at least another adjustment member 21 is connected to the second side surface of the mounting member 6. In other words, the refrigerant adjustment component 20 includes the adjustment member 21 located on the outer side of the mounting member 6 and is connected to the outer side surface of the mounting member 6, and further includes the adjustment member 21 located on the inner side of the mounting member 6 and is connected to the inner side surface of the mounting member 6. The adjustment member 31 located on the inner side of the mounting member 6 is located in inner space between the plurality of first straight sections 31 and the plurality of second straight sections 32. As shown in FIG. 11, the mounting member 6 is disposed on the right side of the right first edge plate 41 and second edge plate 42, at least one adjustment member 21 of the refrigerant adjustment component 20 is disposed on the left side of the mounting member 6 and is connected to the left side surface of the mounting member 6, and at least another adjustment member 21 of the refrigerant adjustment component 20 is disposed on the right side of the mounting member 6 and is connected to the right side surface of the mounting member 6. The adjustment members 21 mounted on both the left and right sides of the mounting member 6 can save installation space, and the adjustment member 21 can exchange heat with intake air, to improve use efficiency.

In some embodiments, the refrigerant adjustment component 20 includes a plurality of adjustment members 21, and every two of at least two adjustment members 21 are communicated with each other. The plurality of adjustment members 21 include a first adjustment member 211. The first adjustment member 211 includes a cavity for accommodating refrigerant and an outer wall enclosing the cavity, and the outer wall of the first adjustment member 211 has an opening for refrigerant flow. There is one first connecting member 30. The opening of the first adjustment member 211 is communicated with the first pipe 1 through the first connecting member 30, and in the direction of gravity, the opening of the first adjustment member 211 is higher than the communication position between the first connecting member 30 and the first pipe 1.

Specifically, the opening of only the first adjustment member 211 in the plurality of adjustment members 21 is communicated with the first pipe 1 through the first connecting member 30, the first adjustment member 211 is communicated with one of the remaining adjustment members 21, and every two of the remaining adjustment members 21 are communicated with each other, so that the plurality of adjustment members 21 are connected in series and then communicated with the first pipe 1 through the first connecting member 30, as shown in FIG. 1 to FIG. 7.

In the embodiments shown in FIG. 1 to FIG. 5, there are two adjustment members 21, the two adjustment members 21 are arranged spaced apart in the front-rear direction, and the front adjustment member 21 is a first adjustment member 211. An outer wall of the first adjustment member 211 is provided with two openings, and an outer wall of the rear adjustment member 21 is provided with one opening. One opening of the first adjustment member 211 is communicated with the first pipe 1 through the first connecting member 30, and the other opening of the first adjustment member 211 is communicated with the opening of the rear adjustment member 21 through a second connecting member 40, so that the two adjustment members 21 are arranged in series.

In the embodiments shown in FIG. 6, FIG. 7, FIG. 12, and FIG. 13, there are three adjustment members 21, the three adjustment members 21 are arranged spaced apart in the front-rear direction, and the front adjustment member 21 of the three adjustment members 21 is a first adjustment member 211. An outer wall of the first adjustment member 211 is provided with two openings, an outer wall of the middle adjustment member 21 is provided with two openings, and an outer wall of the rear adjustment member 21 is provided with one opening. One opening of the first adjustment member 211 is communicated with the first pipe 1 through the first connecting member 30, the other opening of the first adjustment member 211 is communicated with one opening of the middle adjustment member 21 through one second connecting member 40, and the other opening of the middle adjustment member 21 is communicated with the opening of the rear adjustment member 21 through another second connecting member 40, so that the three adjustment members 21 are arranged in series. The adjustment members 21 arranged in series can more flexibly adjust an amount of refrigerant in a system when a working condition changes, especially in the frequency conversion system, and can adapt to various working conditions.

It can be understood that this application is not limited to the foregoing series connection. For example, among the plurality of adjustment members 21, in addition to that the opening of the first adjustment member 211 is communicated with the first pipe 1 through the first connecting member 30, at least one adjustment member 21 of the remaining adjustment members 21 is communicated with the first pipe through a connecting member. In addition, every two of the plurality of adjustment members 21 are communicated, so as to implement a plurality of combination forms of series and parallel connections.

In some embodiments, the refrigerant adjustment component 20 includes a plurality of adjustment members 21, and the plurality of adjustment members 21 each include a cavity for accommodating refrigerant and an outer wall enclosing the cavity. An outer wall of the adjustment member 21 has an opening for refrigerant flow. Openings of the plurality of adjustment members 21 are all communicated with the first pipe 1 through the first connecting member 30, and in the direction of gravity, the opening of each adjustment member 21 is higher than the communication position between the first connecting member 30 and the first pipe 1. In other words, when the heat pump system is switched from the cooling mode to the heating mode, refrigerant in the first pipe 1 may separately flow into the plurality of adjustment members 21 through the first connecting member 30, and when the heat pump system is switched from the heating mode to the cooling mode, refrigerant in the plurality of adjustment members 21 may all fall back into the first pipe 1 due to gravity, so as to implement a form of parallel connection of the plurality of adjustment members 21. Each adjustment member 21 may independently adjust a flow amount of refrigerant, which further helps refrigerant flow, thereby improving efficiency of the heat pump system.

Figure 15:
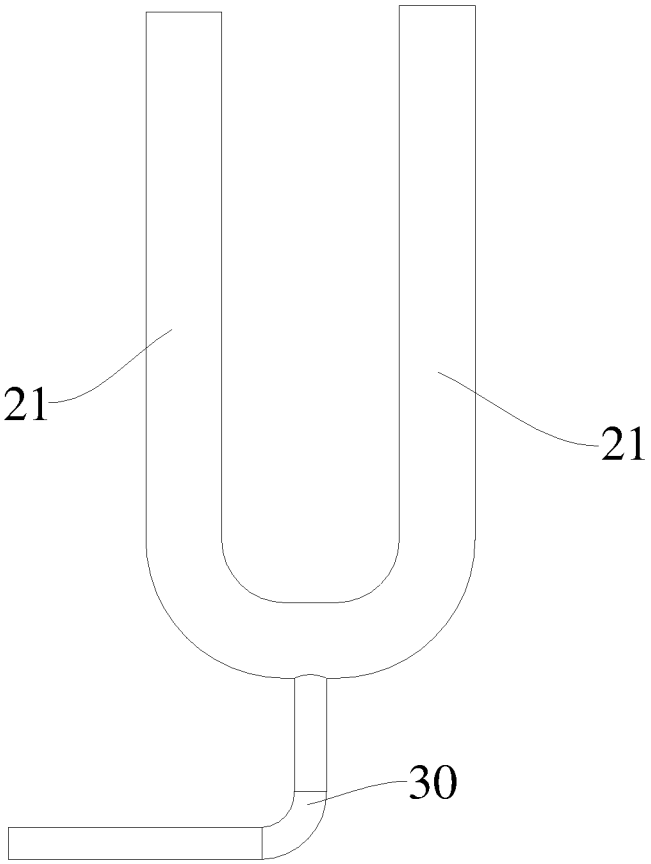
FIG. 15 is a schematic diagram of a refrigerant adjustment component of a heat exchanger according to an embodiment of this application.
Figure 16:
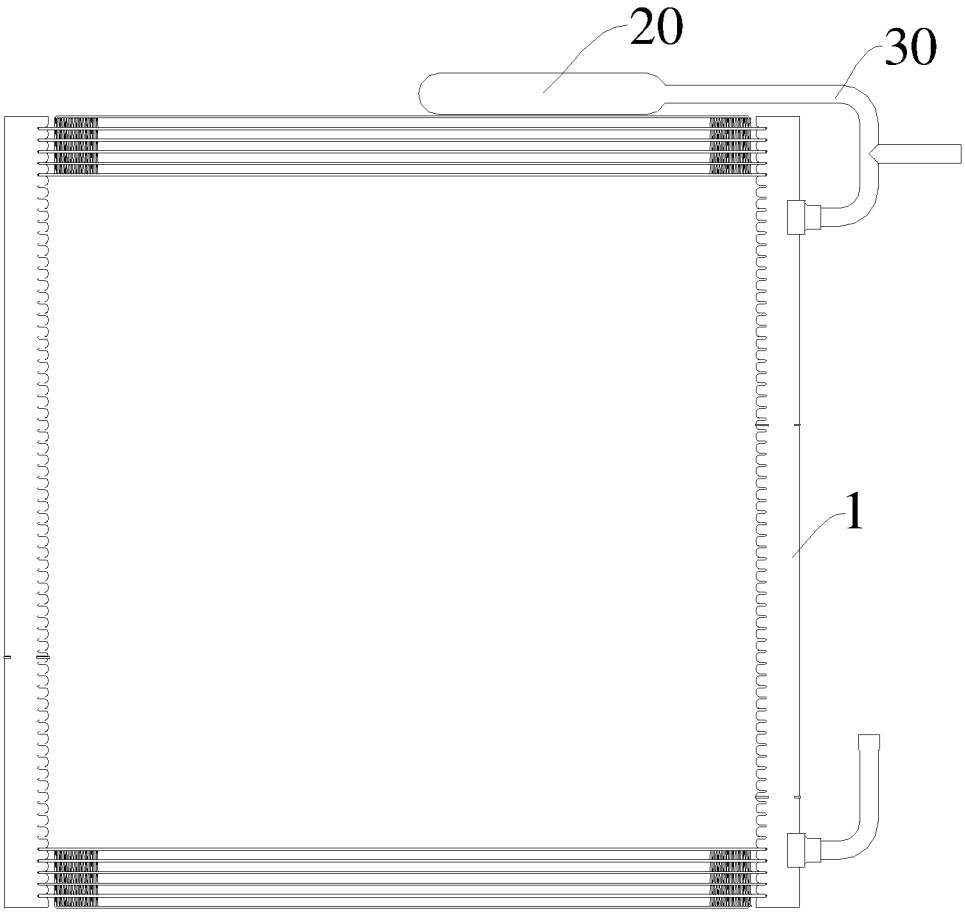
FIG. 16 is a main view of a heat exchanger according to a yet further embodiment of this application.
Figure 17:
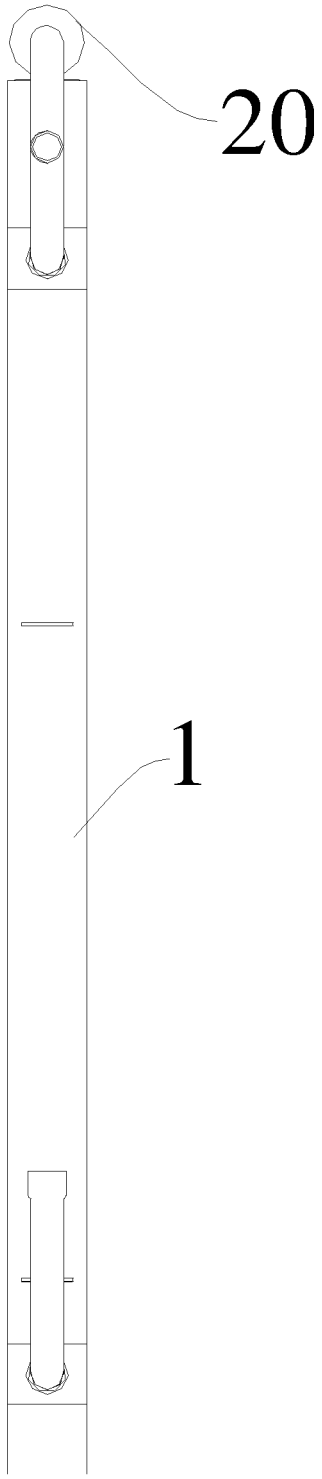
FIG. 17 is a side view of the heat exchanger in FIG. 16.
Figure 18:
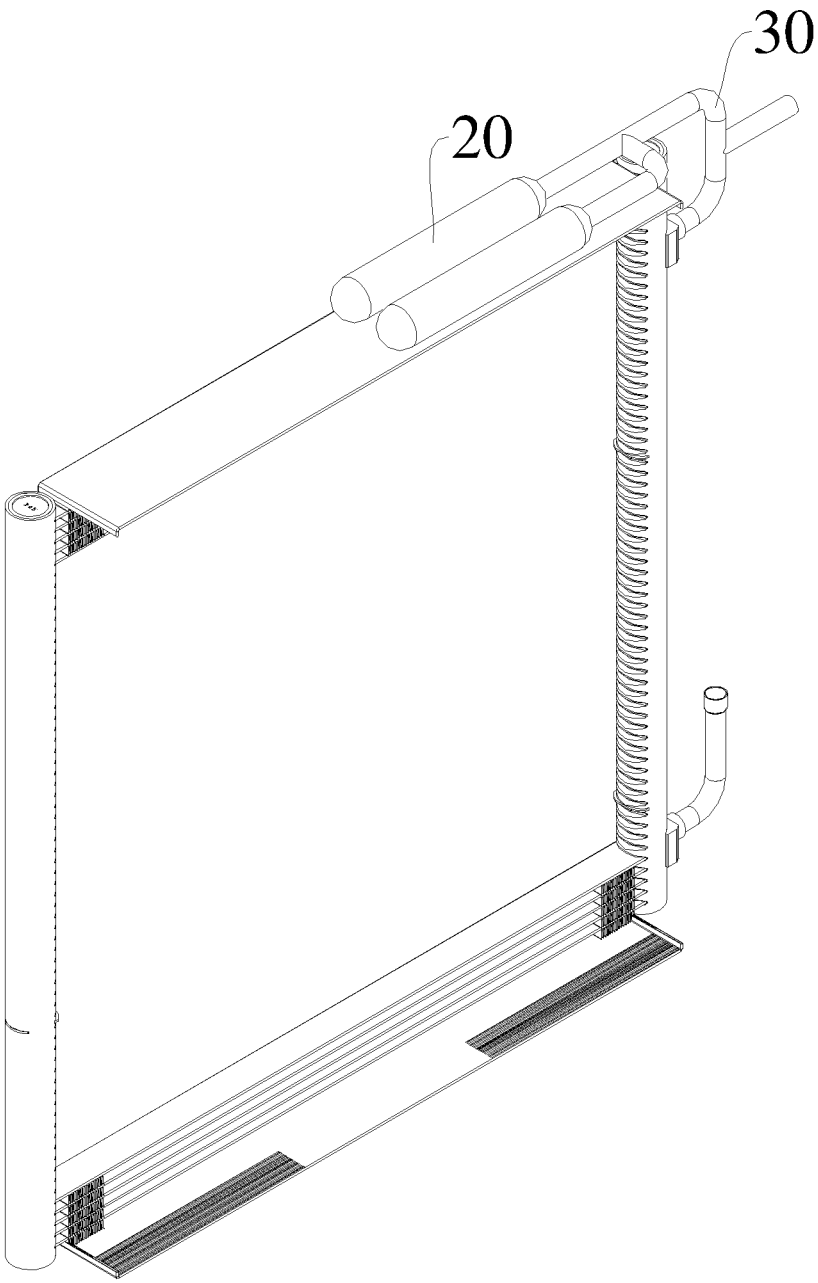
FIG. 18 is a schematic diagram of a structure of a heat exchanger according to still yet further embodiment of this application.
Figure 19:
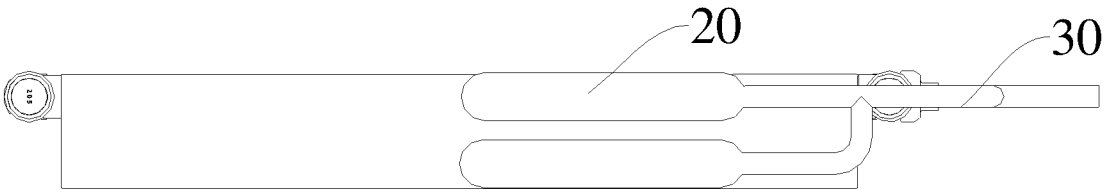
FIG. 19 is a top view of the heat exchanger in FIG. 18.
Figure 20:
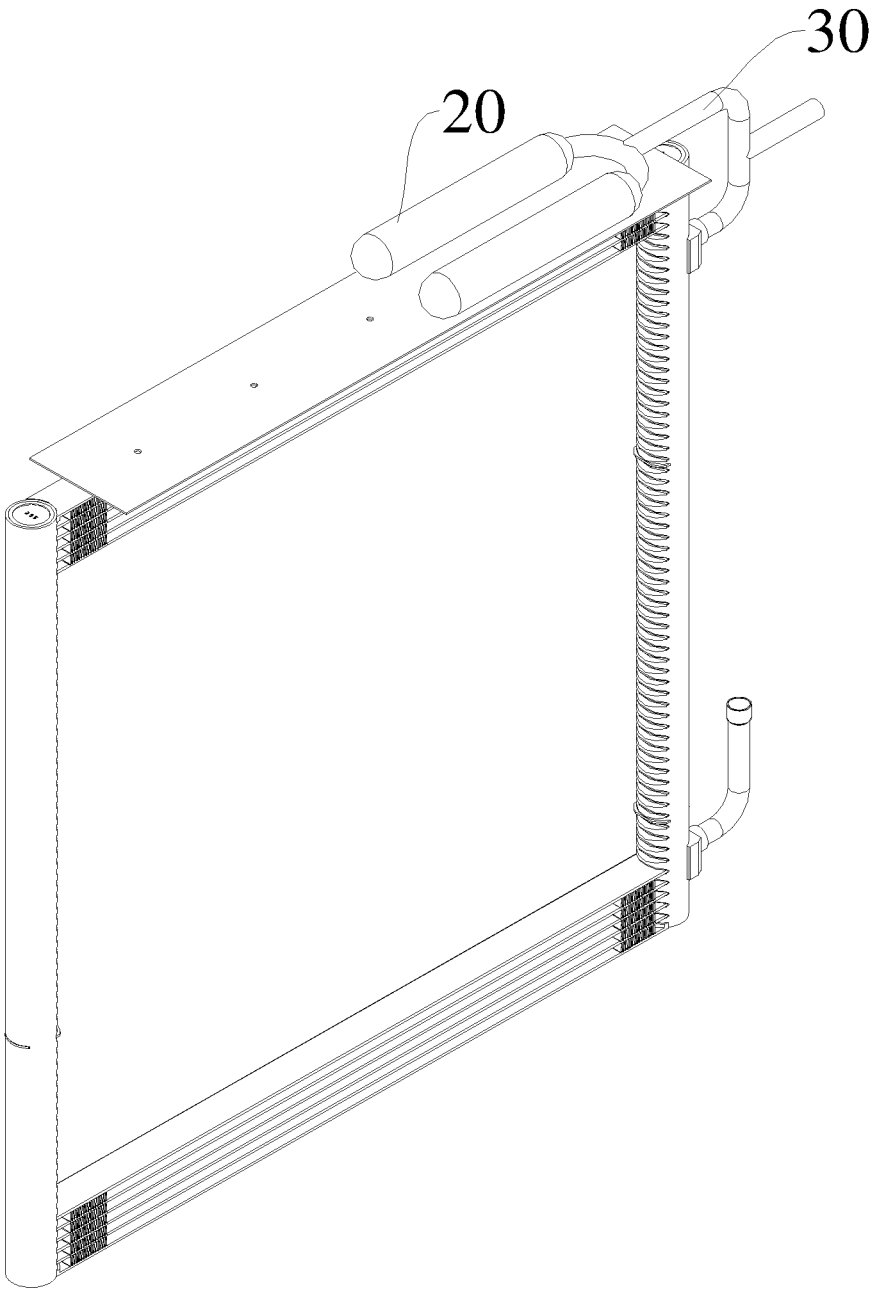
FIG. 20 is a schematic diagram of a structure of a heat exchanger according to even yet another further embodiment of this application.
Figure 21:
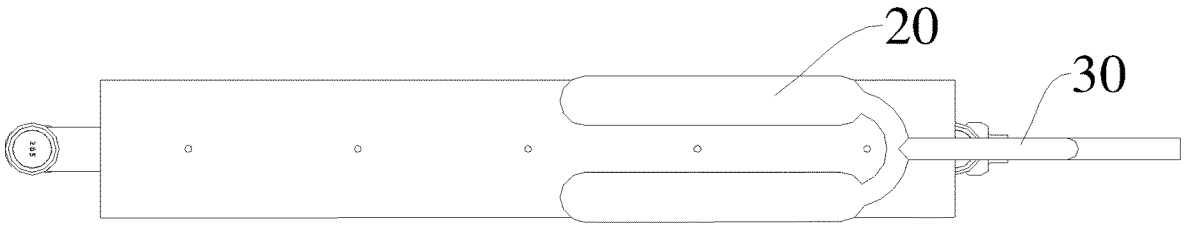
FIG. 21 is a top view of the heat exchanger in FIG. 20.
Figure 22:
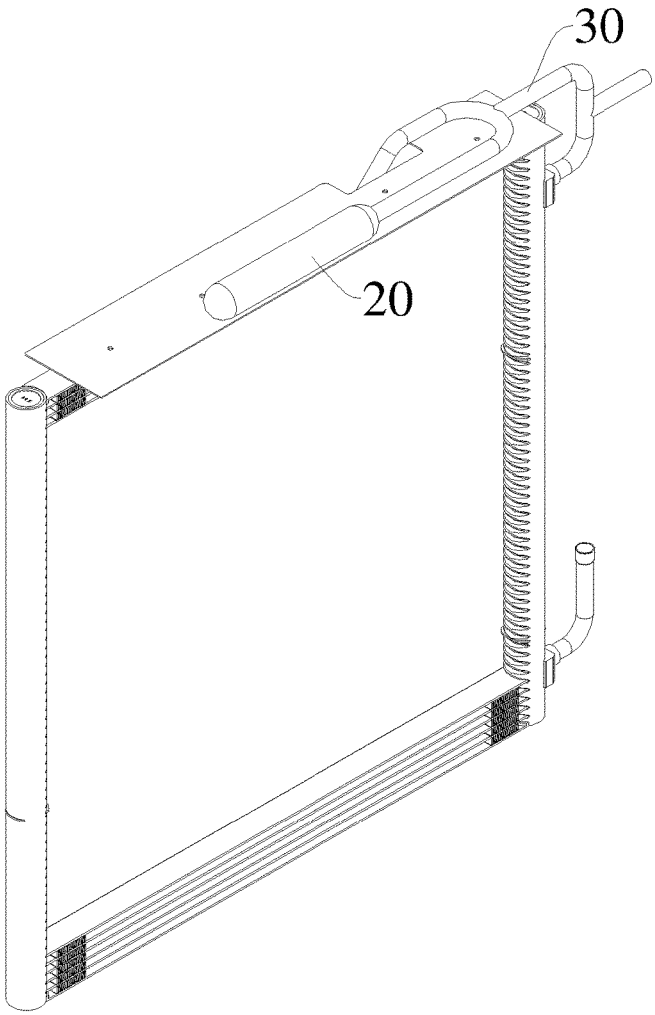
FIG. 22 is a schematic diagram of a structure of a heat exchanger according to even still another embodiment of this application.
Figure 23:
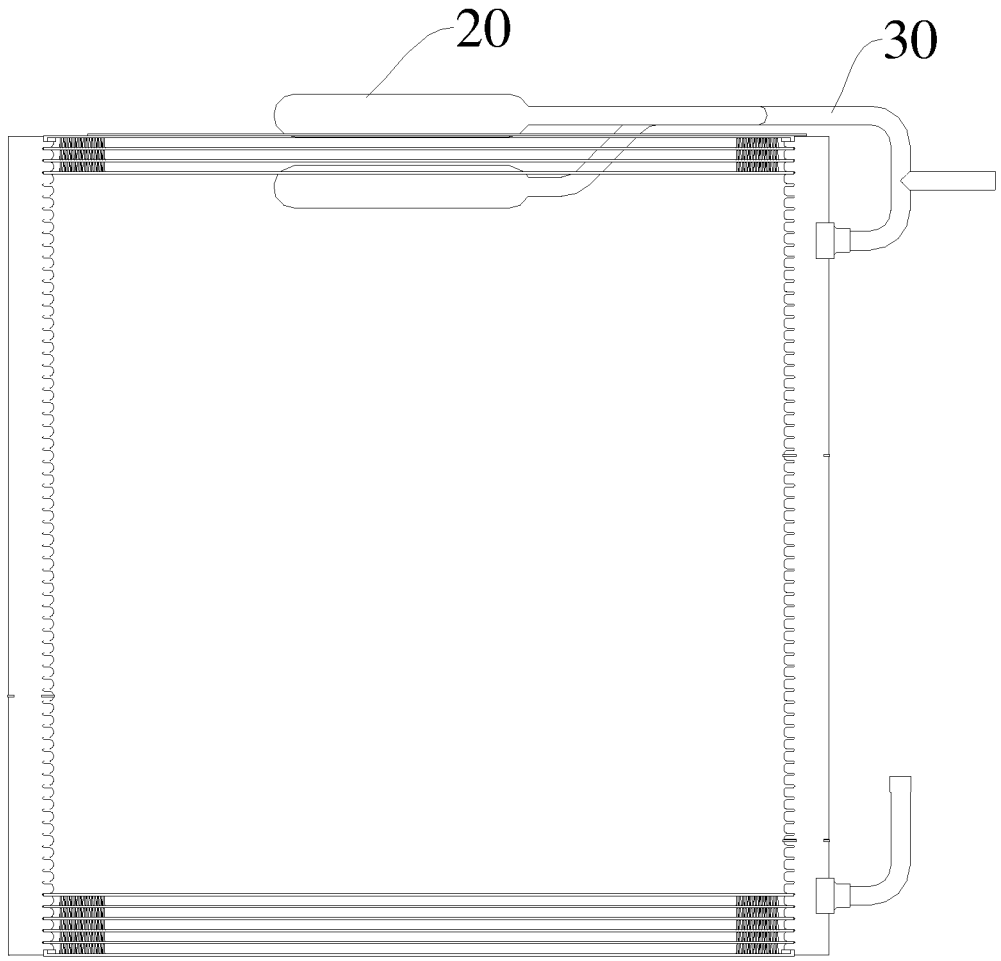
FIG. 23 is a main view of the heat exchanger in FIG. 22.
Figure 24:
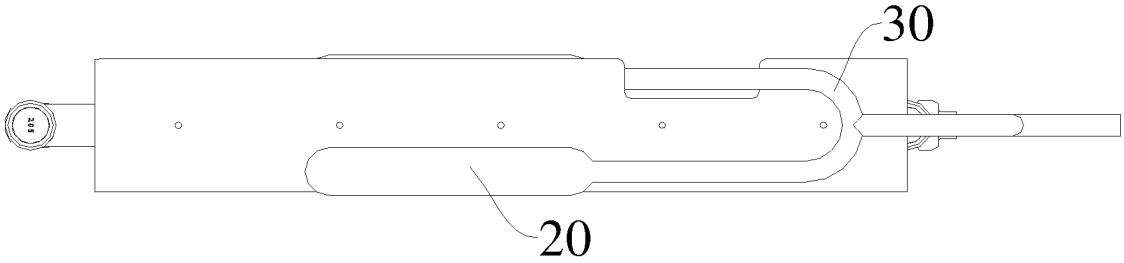
FIG. 24 is a top view of the heat exchanger in FIG. 22.

There are a plurality of arrangement forms of the first connecting member 30. For example, in some specific embodiments, there are a plurality of first connecting members 30, each of the adjustment members 21 corresponds to one first connecting member 30, and each of the adjustment members 21 is communicated with the first pipe 1 through a corresponding first connecting member 30. For example, in some other specific embodiments, there is one first connecting member 30, and the plurality of adjustment members 21 are integrally formed and are communicated with the first pipe 1 through the first connecting member 30, as shown in FIG. 15.

In some embodiments, the adjustment member 21 is an adjustment pipe, and a hydraulic diameter of the adjustment pipe is greater than 0.5 times of a hydraulic diameter of the first pipe 1 and less than 2 times of the hydraulic diameter of the first pipe 1. Therefore, an amount of exchanged heat and an energy efficiency ratio in different modes are further stabilized, thereby improving efficiency of the heat pump system.

In some embodiments, a volume of the refrigerant adjustment component 20 is greater than 0.25 times of a volume of the first pipe 1 and less than 5 times of the volume of the first pipe 1, so as to further stabilize an amount of exchanged heat and an energy efficiency ratio on the indoor side in different modes, thereby improving efficiency of the heat pump system.

In some embodiments, the heat exchanger 10 further includes fins 7, and the fins 7 are disposed between adjacent heat exchange tubes 3, to increase a heat exchange area of two adjacent heat exchange tubes 3, thereby improving heat exchange efficiency of the heat exchanger 10.

Specifically, when the heat exchanger 10 is a bent heat exchanger, the fins 7 are disposed between adjacent first straight sections 32 and between adjacent second straight sections 32, and no fins 7 are disposed adjacent bent sections 33.

Figure 25:
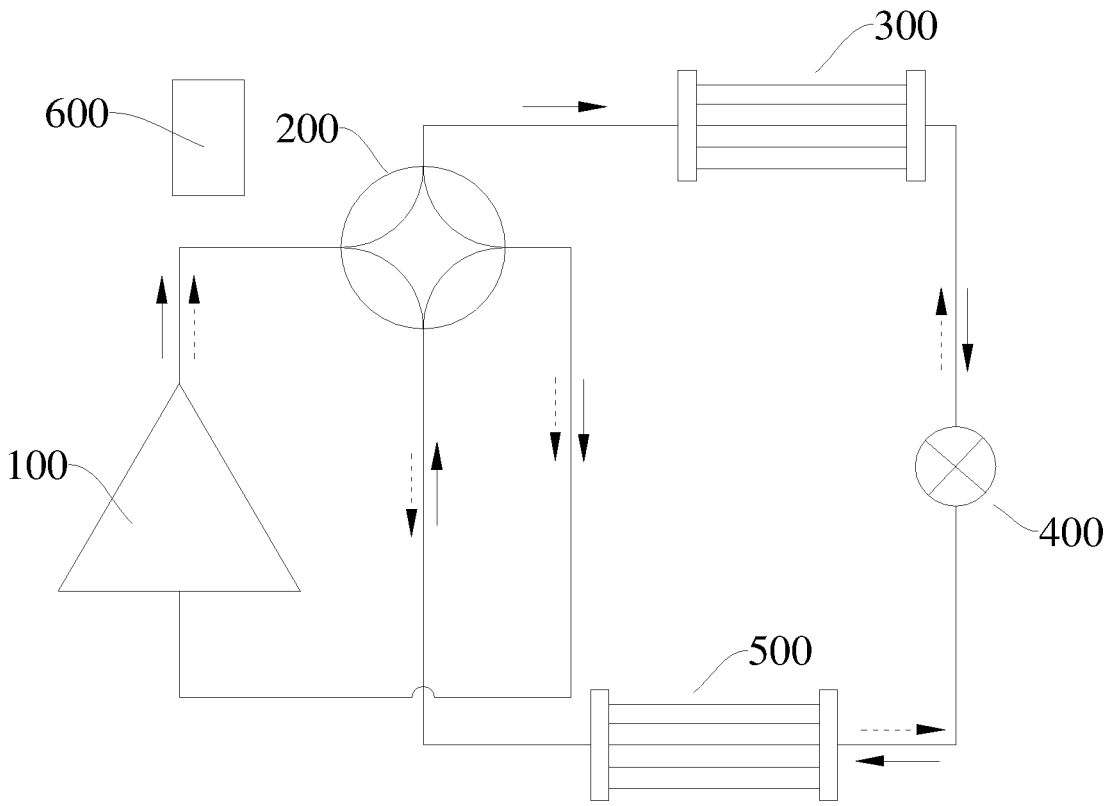
FIG. 25 is a schematic diagram of a refrigeration system including a heat exchange apparatus according to an embodiment of this application.

The following describes, with reference to FIG. 25, a heat pump system including the heat exchange apparatus according to the embodiment of this application.

The heat pump system includes a compressor 100, a flow direction switching member 200, a first heat exchanger 300, a throttle member 400, a second heat exchanger 500, and a controller 600. The compressor 100, the first heat exchanger 300, and the second heat exchanger 500 each include a first opening and a second opening. The first opening of the first heat exchanger 300 is communicated with the first opening of the compressor 100 through the flow direction switching member 200, and the second opening of the first heat exchanger 300 is communicated with the first opening of the throttle member 400. The first opening of the second heat exchanger 500 is communicated with the second opening of the throttle member 400, and the second opening of the second heat exchanger 500 is communicated with the second opening of the compressor 100 through the flow direction switching member 200. Specifically, adjacent apparatus in the heat pump system are communicated at least through a pipe.

When the heat pump system works, the system is filled with refrigerant, and the refrigerant may circulate in the heat pump system. Driven by the controller 600, the flow direction switching member 200 is configured to change a flow direction of the refrigerant in the heat exchange system. In other words, under the action of the flow direction switching member 200, the refrigerant may flow out from the compressor 100, first pass through the first heat exchanger 300 and then the second heat exchanger 500, and then flow back to the compressor 100; or may flow out from the compressor 100, first pass through the second heat exchanger 500 and then the first heat exchanger 300, and then flow back to the compressor 100.

At least one of the first heat exchanger 300 and the second heat exchanger 500 is the heat exchange apparatus according to the embodiment of this application. Therefore, the first heat exchanger 300 and/or the second heat exchanger 500 can accommodate more refrigerant, to adjust an amount of refrigerant working in a system, thereby improving system efficiency.

In the description of this specification, descriptions with reference to the term such as "an embodiment", "some embodiments", "example", "specific example", or "some examples" mean that specific features, structures, materials, or characteristics described with reference to the embodiment or example are included in at least one embodiment or example of this application. In this specification, illustrative descriptions of the foregoing terms do not necessarily refer to a same embodiment or example. Moreover, the described specific features, structures, materials, or characteristics can be combined in any one or more embodiments or examples in an appropriate manner. In addition, those skilled in the art can combine different embodiments or examples described in the specification and features of the different embodiments or examples without contradicting each other.

The terms "first", "second", and the like in the description of this application are merely used for the purpose of description, and cannot be understood as indicating or implying relative importance. In the description of this application, "a plurality of" means at least two, such as two or three, unless otherwise specifically defined.

In this application, unless otherwise expressly specified and defined, terms such as "install", "connect", "connected to", and "fasten" should be understood in a broad sense. For example, unless otherwise expressly defined, a "connection" may be a fixed connection, may be a detachable connection, or may be an integrated connection; or may be a mechanical connection, or an electrical connection or, mutually communicative connection; or may be a direct connection, or an indirect connection through an intermediate medium; or may be an inner communication between two elements, or interaction between two elements. A person of ordinary skill in the art may understand specific meanings of the foregoing terms in this application with reference to specific circumstances.

In this application, unless otherwise expressly specified and defined, that a first feature is "above" or "below" a second feature means that the first feature and the second feature are in direct contact, or are in indirect contact through an intermediate medium. Moreover, that the first feature is "over", "above", or "on" the second feature may mean that the first feature is over or obliquely above the second feature, or merely mean that the first feature is higher than the second feature in terms of heights. That the first feature is "under", "below", "under", or "beneath" the second feature may mean that the first feature is under or obliquely below the second feature, or merely mean that the first feature is lower than the second feature in terms of heights.

Although the embodiments of this application are shown and described above, it can be understood that the foregoing embodiments are examples and shall not be construed as a limitation on this application. A person of ordinary skill in the art may make changes, modifications, substitutions, and variants based on the foregoing embodiments within the scope of this application.

The invention claimed is:

1. A heat exchange apparatus, comprising:

a heat exchanger comprising a first pipe, a second pipe, and a plurality of heat exchange tubes, the first pipe and the second pipe being arranged spaced apart from each other, the plurality of heat exchange tubes being arranged spaced apart along a length direction of the first pipe, wherein one end of the plurality of heat exchange tubes is inserted into the first pipe to be communicated with the first pipe, and another end of the plurality of heat exchange tubes is inserted into the second pipe to be communicated with the second pipe, wherein the plurality of heat exchange tubes comprises a channel, the channel communicating the first pipe and the second pipe, wherein each of the plurality of heat exchange tubes comprise a first straight section, a second straight section, and a connecting section, an angle between a length direction of the first straight section and a length direction of the second straight section is greater than or equal to 0° and less than 180°, wherein the heat exchanger further comprises edge plates, each of the edge plates being disposed on an outer side of the plurality of heat exchange tubes in the length direction of the first pipe;

a refrigerant adjustment component, wherein at least part of the refrigerant adjustment component is disposed on an outer side of the edge plates in the length direction of the first pipe, wherein the refrigerant adjustment component comprises a cavity configured to accommodate refrigerant and an outer wall enclosing the cavity, wherein the outer wall of the refrigerant adjustment component has an opening for refrigerant flow, and wherein an angle between an axis in a length direction of at least part of the outer wall of the refrigerant adjustment component and an axis in the length direction of the first pipe is greater than 0° and less than or equal to 90°;

a first connecting member, wherein the first connecting member communicates the opening of the refrigerant adjustment component and the first pipe, and in a direction of gravity, the opening of the refrigerant adjustment component is disposed higher than a communication position between the first connecting member and the first pipe; and a mounting member, the mounting member being disposed on the outer side of the edge plates in the length direction of the first pipe, and the refrigerant adjustment component is fixedly connected to the mounting member, wherein the mounting member comprises a first side surface and a second side surface arranged spaced apart in the length direction of the first pipe, and the refrigerant adjustment component is connected to at least one of the first side surface and the second side surface of the mounting member.

2. The heat exchange apparatus according to claim 1, wherein each of the edge plates comprises a first side surface and a second side surface arranged opposite to each other in the length direction of the first pipe, and the refrigerant adjustment component is connected to at least one of the first side surface and the second side surface of each the edge plates.

3. The heat exchange apparatus according to claim 1, wherein the refrigerant adjustment component comprises a plurality of adjustment members, at least one adjustment member of the plurality of adjustment members is connected to the first side surface of the mounting member, and at least another adjustment member of the plurality of adjustment members is connected to the second side surface of the mounting member.

4. The heat exchange apparatus according to claim 3, wherein each of the plurality of adjustment members is an adjustment pipe, and a hydraulic diameter of the adjustment pipe is greater than 0.5 times of a hydraulic diameter of the first pipe and less than 2 times of the hydraulic diameter of the first pipe.

5. The heat exchange apparatus according to claim 1, wherein the refrigerant adjustment component comprises a plurality of adjustment members, every two of at least two adjustment members are communicated with each other, wherein the plurality of adjustment members comprise a first adjustment member, wherein the first adjustment member comprises a cavity configured to accommodate refrigerant and an outer wall enclosing the cavity, the outer wall of the first adjustment member having an opening, wherein the opening of the first adjustment member is communicated with the first pipe through the first connecting member, and in the direction of gravity, the opening of the first adjustment member is positioned higher than the communication position between the first connecting member and the first pipe.

6. The heat exchange apparatus according to claim 5, wherein the first adjustment member is communicated with another of the plurality of adjustment members, and every two of other adjustment members of the plurality of adjustment members are communicated with each other.

7. The heat exchange apparatus according to claim 1, wherein the refrigerant adjustment component comprises a plurality of adjustment members, wherein each of the plurality of adjustment members comprises a cavity configured to accommodate refrigerant and an outer wall enclosing the cavity, the outer wall of each of the plurality of adjustment members having an opening for refrigerant flow, wherein the openings of the plurality of adjustment members are communicated with the first pipe through the first connecting member, and in the direction of gravity, the opening of each of the plurality of adjustment members is higher than the communication position between the first connecting member and the first pipe.

8. The heat exchange apparatus according to claim 7,
wherein the first connecting member comprises a plurality of first connecting members, each of the plurality of adjustment members corresponds to each of the plurality of first connecting members, and each of the plurality of adjustment members is communicated with the first pipe through a corresponding each of the plurality of first connecting members.

9. The heat exchange apparatus according to claim 7,
wherein the first connecting member has one first connecting member, and the plurality of adjustment members are integrally formed and are communicated with the first pipe through the one first connecting member.

10. The heat exchange apparatus according to claim 1,
wherein a volume of the refrigerant adjustment component is greater than 0.25 times of a volume of the first pipe and less than 5 times of the volume of the first pipe.

11. The heat exchange apparatus according to claim 1,
wherein one end of the first straight section in a length direction of the first straight section is inserted into the first pipe to be communicated with the first pipe, another end of the first straight section in the length direction of the first straight section is communicated with one end of the connecting section, one end of the second straight section in a length direction of the second straight section is inserted into the second pipe to be communicated with the second pipe, another end of the second straight section in the length direction of the second straight section is communicated with another end of the connecting section,
and
wherein the edge plates comprise a first edge plate and a second edge plate,
wherein the first edge plate is disposed on an outer side of the first straight sections of the plurality of heat exchange tubes in the length direction of the first pipe, the second edge plate is disposed on an outer side of the second straight sections of the plurality of heat exchange tubes in the length direction of the first pipe, and the at least part of the refrigerant adjustment component is located on an outer side of the first edge plate and the second edge plate in the length direction of the first pipe.

12. The heat exchange apparatus according to claim 11,
wherein the connecting section is bent with respect to the first straight section and the second straight section.

13. The heat exchange apparatus according to claim 11,
wherein the connecting section is twisted and bent with respect to the first straight section and the second straight section.

14. The heat exchange apparatus according to claim 1,
wherein one end of the first connecting member is communicated with the opening of the refrigerant adjustment component, another end of the first connecting member is directly communicated with the first pipe, and the opening of the refrigerant adjustment component is higher than a communication position between the another end of the first connecting member and the first pipe.

15. The heat exchange apparatus according to claim 1,
wherein an end of the first pipe in the length direction is connected to an inlet/outlet pipe, one end of the first connecting member is communicated with the opening of the refrigerant adjustment component, another end of the first connecting member is communicated with the inlet/outlet pipe, and the opening of the refrigerant adjustment component is positioned higher than a communication position between the another end of the first connecting member and the inlet/outlet pipe.

16. The heat exchange apparatus according to claim 1,
wherein the refrigerant adjustment component is fastened on the mounting member by a fastener.

17. A heat pump system, comprising:
a compressor, a flow direction switching member, a throttle member, a first heat exchanger, and a second heat exchanger,
wherein the compressor, the throttle member, the first heat exchanger, and the second heat exchanger each comprise a first opening and a second opening, the first opening of the first heat exchanger is communicated with the first opening of the compressor through the flow direction switching member, the second opening of the first heat exchanger is communicated with the first opening of the throttle member, the first opening of the second heat exchanger is communicated with the second opening of the throttle member, and the second opening of the second heat exchanger is communicated with the second opening of the compressor through the flow direction switching member,
wherein at least one of the first heat exchanger and the second heat exchanger comprises:
a first pipe, a second pipe, and a plurality of heat exchange tubes,
wherein the first pipe and the second pipe are arranged spaced apart from each other,
wherein the plurality of heat exchange tubes are arranged spaced apart along a length direction of the first pipe,
wherein one end of the plurality of heat exchange tubes is inserted into the first pipe to be communicated with the first pipe, another end of the plurality of heat exchange tubes is inserted into the second pipe to be communicated with the second pipe,
wherein the plurality of heat exchange tubes comprises a channel, the channel communicating the first pipe and the second pipe,
wherein each of the plurality of heat exchange tubes comprise a first straight section, a second straight section, and a connecting section, an angle between the length direction of the first straight section and the length direction of the second straight section is greater than or equal to 0° and less than 180°,
wherein the at least one of the first heat exchanger and the second heat exchanger further comprises edge plates, each of the edge plates being disposed on an outer side of the plurality of heat exchange tubes in the length direction of the first pipe;
a refrigerant adjustment component,
wherein at least part of the refrigerant adjustment component is disposed on an outer side of the edge plates in the length direction of the first pipe,
wherein the refrigerant adjustment component comprises a cavity configured to accommodate refrigerant and an outer wall enclosing the cavity, the outer wall of the refrigerant adjustment component having an opening for refrigerant flow, and
wherein an angle between an axis in a length direction of at least part of the outer wall of the refrigerant adjustment component and an axis in the length direction of the first pipe is greater than 0° and less than or equal to 90°;
a first connecting member,
wherein the first connecting member communicates the opening of the refrigerant adjustment component and the first pipe, and in a direction of gravity, the opening of the refrigerant adjustment component is disposed higher than a communication position between the first connecting member and the first pipe; and a mounting member, the mounting member being disposed on the outer side of the edge plates in the length direction of the first pipe, and the refrigerant adjustment component is fixedly connected to the mounting member, wherein the mounting member comprises a first side surface and a second side surface arranged spaced apart in the length direction of the first pipe, and the refrigerant adjustment component is connected to at least one of the first side surface and the second side surface of the mounting member.

* * * * *